US009336667B2

(12) United States Patent
Hammoud

(10) Patent No.: US 9,336,667 B2
(45) Date of Patent: May 10, 2016

(54) ELECTRONIC MAILBOX SYSTEM

(71) Applicant: Hassan Hammoud, Windsor (CA)

(72) Inventor: Hassan Hammoud, Windsor (CA)

( * ) Notice: Subject to any disclaimer, the term of this patent is extended or adjusted under 35 U.S.C. 154(b) by 0 days.

(21) Appl. No.: 13/760,885

(22) Filed: Feb. 6, 2013

(65) Prior Publication Data

US 2013/0147626 A1 Jun. 13, 2013

Related U.S. Application Data

(63) Continuation-in-part of application No. 12/707,948, filed on Feb. 18, 2010.

(60) Provisional application No. 61/167,102, filed on Apr. 6, 2009.

(51) Int. Cl.

| | |
|---|---|
| ***G08B 13/14*** | (2006.01) |
| ***G08B 13/22*** | (2006.01) |
| ***A47G 29/122*** | (2006.01) |
| ***A47G 29/14*** | (2006.01) |
| *G08B 13/196* | (2006.01) |
| *A47G 29/12* | (2006.01) |

(52) U.S. Cl.

CPC ..... *G08B 13/22* (2013.01); *A47G 29/1214* (2013.01); *A47G 29/141* (2013.01); *A47G 29/1203* (2013.01); *A47G 2029/1226* (2013.01); *G08B 13/149* (2013.01); *G08B 13/19697* (2013.01)

(58) Field of Classification Search

USPC ..... 340/569, 568.1, 545.6, 572.1, 10.1, 340/5.52; 709/206, 218; 370/311; 713/170; 345/440

See application file for complete search history.

(56) References Cited

U.S. PATENT DOCUMENTS

| | | | | |
|---|---|---|---|---|
| 5,774,053 | A * | 6/1998 | Porter | 340/568.1 |
| 6,693,511 | B1 * | 2/2004 | Seal | 340/10.1 |
| 6,788,203 | B1 * | 9/2004 | Roxbury et al. | 340/545.6 |
| 7,046,247 | B2 * | 5/2006 | Hao et al. | 345/440 |
| 7,392,388 | B2 * | 6/2008 | Keech | 713/170 |
| 8,060,582 | B2 * | 11/2011 | Bliss et al. | 709/218 |
| 8,095,603 | B2 * | 1/2012 | Hung et al. | 709/206 |
| 8,295,450 | B2 * | 10/2012 | Helferich | 379/88.22 |
| 2005/0253715 | A1 * | 11/2005 | Awobue | 340/569 |
| 2006/0109120 | A1 * | 5/2006 | Burr et al. | 340/572.1 |
| 2010/0097970 | A1 * | 4/2010 | Jang | 370/311 |

* cited by examiner

*Primary Examiner* — Steven Lim
*Assistant Examiner* — Kaleria Knox
(74) *Attorney, Agent, or Firm* — Ryan W. Dupuis; Kyle R. Satterthwaite; Ade & Company Inc.

(57) ABSTRACT

An electronic mailbox system features: a mailbox housing with an inner cavity and slot for holding mail, a lid, an electrically-operable lock system for the lid, a mail sensor for detecting the mail being inserted into the slot, a first transmitter, a first receiver and a mailbox microprocessor; and a control box with a second transmitter, a second receiver, a control box indicator light, an unlock button, a reset button, and a control box microprocessor. When the mail sensor detects mail delivery the control box indicator light becomes illuminated. When the unlock button is pushed the lock system unlocks. When the reset button is pressed the indicator light is deactivated. An alarm system may be activated upon receipt of mail and/or if a tamper sensor detects tampering. Another embodiment features control and monitoring of the mailbox via a mobile consumer electronics device, as a smart phone or tablet.

20 Claims, 30 Drawing Sheets

FIG. 12
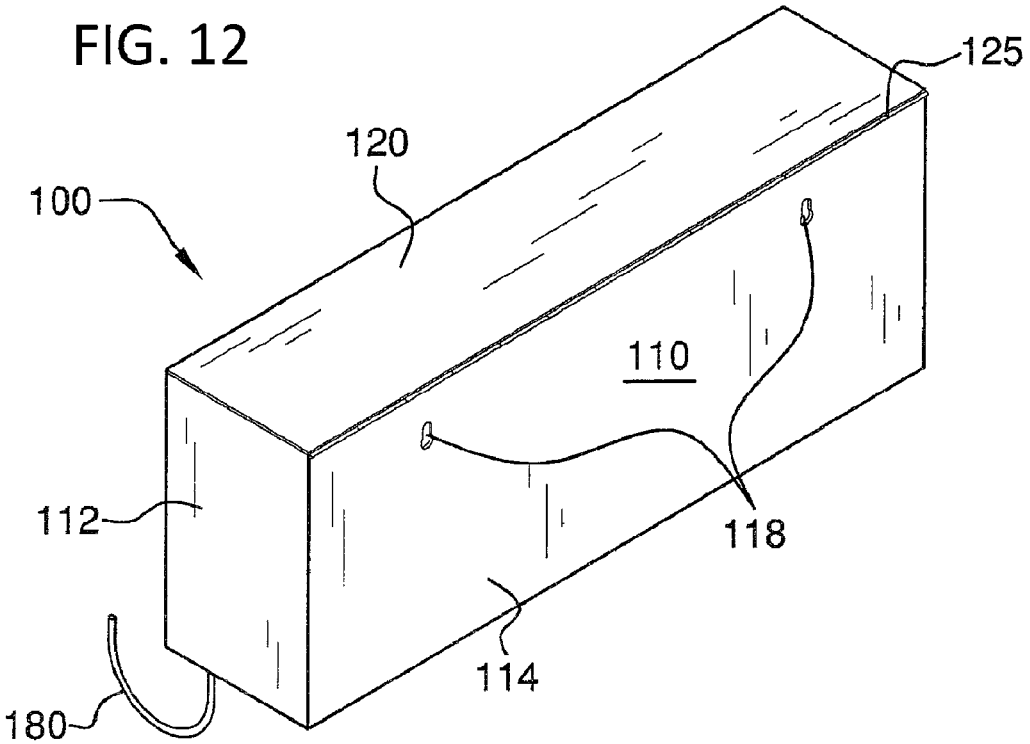
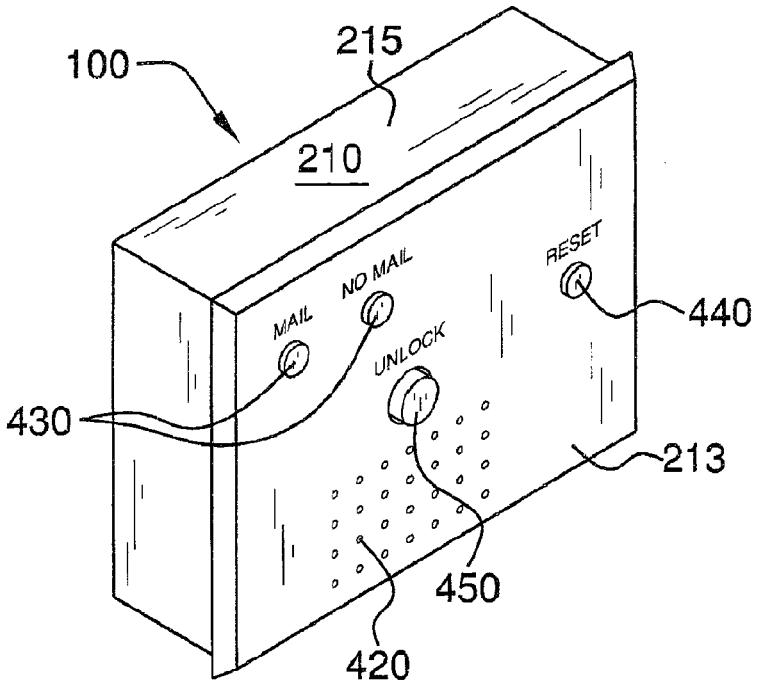
FIG. 13

ELECTRONIC MAILBOX SYSTEM

CROSS REFERENCE TO RELATED APPLICATIONS

This application is a continuation-in-part of U.S. Non-Provisional application Ser. No. 12/707,948, filed Feb. 18, 2010, which in turn claimed benefit of U.S. Provisional Application Ser. No. 61/167,102 filed Apr. 6, 2009, both of which are incorporated herein by reference in entirety.

FIELD OF THE INVENTION

The present invention is directed to a mailbox. More particularly, the present invention is directed to an electronic mailbox having an electronic means of securing mail and a transmit-receiver system for alerting a user when mail has arrived.

BACKGROUND OF THE INVENTION

Although it is illegal for individuals to take or tamper with another individual's mail, it is a very common occurrence. The present invention features an electronic mailbox system for providing a secure environment for receiving mail. The electronic mailbox system comprises a mailbox housing having an electronic lock that can only be opened by the user.

The system can detect when mail arrives and alert the user (via a control box) that mail is in the mailbox.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

SUMMARY OF THE INVENTION

The present invention features electronic mailbox systems. In some embodiments, the system comprises a mailbox housing comprising: (i) an inner cavity for holding a piece of mail; (ii) a lid moveable between an open position and a closed position respectively allowing and preventing access to the inner cavity; (iii) an electrically-operable lock system operatively connected to the lid, the lock system can move between a locked position which secures the lid in the closed position and an unlocked position which permits the lid to be moved to the open position; (iv) a slot disposed in the mailbox housing for accommodating the piece of mail; (v) a mail sensor (such as an optical sensor) for detecting the piece of mail being inserted into the slot; (vi) a first transmitter and a first receiver; and (vii) a mailbox microprocessor operatively connected to each of the mail sensor, the lock system, the first transmitter, and the first receiver. The system may further comprise a tamper sensor for detecting tampering of the mailbox housing, the tamper sensor being operatively connected to the mailbox microprocessor.

The system of some embodiments further comprises a control box comprising (i) a second transmitter and a second receiver, wherein the second receiver is configured to receive signals from the first transmitter and the first receiver is configured to receive signals from the second transmitter; (ii) a control box indicator light; (iii) an unlock button; (iv) a reset button; and (v) a control box microprocessor operatively connected to each the second transmitter, the second receiver, the control box indicator light, the unlock button, and the reset button. In some embodiments, the system further comprises an alarm system operatively connected to the control box microprocessor.

In some embodiments, the mailbox microprocessor is configured to receive a first sensor input signal from the mail sensor when the mail sensor detects the piece of mail being inserted into the slot whereupon the mailbox microprocessor generates a first transmitter output command to the first transmitter to cause the first transmitter to send a first transmitter signal to the second receiver in the control box. In some embodiments, the second receiver is configured to send a second receiver input signal to the control box microprocessor when the second receiver receives the first transmitter signal from the first transmitter, whereupon the control box microprocessor generates a second light output command to the control box indicator light to cause the control box indicator light to become activated.

In some embodiments, the control box microprocessor is configured to receive a first unlock input signal from the unlock button when the unlock button is pressed whereupon the control box microprocessor generates a second transmitter output command to the second transmitter to cause the second transmitter to send a second transmitter signal to the first receiver in the mailbox housing. In some embodiments, the first receiver is configured to send a second unlock input signal to the mailbox microprocessor when the first receiver receives the second transmitter signal from the second transmitter, whereupon the mailbox microprocessor generates an unlock output command to the lock system to cause the lock system to move to the unlocked position.

In some embodiments, the mailbox microprocessor is configured to receive a second sensor input signal from the tamper sensor when the tamper sensor detects tampering, wherein upon receipt of the second sensor input signal the mailbox microprocessor generates a fourth transmitter output command to the first transmitter to cause the first transmitter to send a fourth transmitter signal to the second receiver. In some embodiments, upon receipt of the fourth transmitter signal, the second receiver sends a fourth receiver input signal to the control box microprocessor whereupon the control box microprocessor generates a second alarm output command to the alarm system to activate the alarm system.

In some embodiments, the control box microprocessor is configured to receive a first reset input signal from the reset button when the reset button is pressed whereupon the control box microprocessor generates (i) a first reset output command to the control box indicator light to cause the control box indicator light to become deactivated; or (2) a third reset output command to the alarm system to deactivate the alarm, whether or not such a first reset output command is also generated.

In some embodiments, the mailbox housing further comprises a mailbox indicator light operatively connected to the mailbox microprocessor, wherein when the mailbox microprocessor receives the first sensor input signal from the mail sensor the mailbox microprocessor generates a first light output command to the mailbox indicator light to activate the mailbox indicator light. In some embodiments, when the control box microprocessor receives the first reset input signal from the reset button the control box microprocessor generates a second reset output command to the second transmitter to cause the second transmitter to send a third transmitter signal to the first receiver in the mailbox housing; wherein the first receiver is configured to send a second light input signal to the mailbox microprocessor when the first receiver receives the third transmitter signal from the second transmitter, whereupon the mailbox microprocessor generates a second light output command to the mailbox indicator light to deactivate the mailbox indicator light.

In some embodiments, the system further comprises a newspaper holder disposed on the mailbox housing. In some embodiments, the mailbox housing further comprises an awning positioned over the slot to help prevent moisture from entering into the slot. In some embodiments, the mailbox housing further comprises an inner door attached to an inside surface of a front surface of the mailbox housing such that it covers the slot, the inner door is moveable between an open position and a closed position respectively allowing and preventing access to the inner cavity of the mailbox housing, the inner door is biased in the closed position caused by a spring. In some embodiments, the lock system comprises a good lock light for indicating the lock system is in the locked position. In some embodiments, the unlock button comprises a keypad system. In some embodiments, the lock system comprises an emergency unlocking mechanism.

In some embodiments, when the control box microprocessor receives the second receiver input signal the control box microprocessor generates a first alarm output command to the alarm system to activate the alarm system. In some embodiments, the alarm system is configured to emit a first sound when the alarm system receives the first alarm output command and the alarm system is configured to emit a second sound when the alarm system receives the second alarm output command.

In some embodiments, the lock system comprises an auto-lock mechanism, the auto-lock mechanism function to causing the lock system to become locked after a certain length of time after the lock system has been unlocked. In some embodiments, if the lock system is not relocked after the certain length of time the alarm system is activated.

According to one aspect of the invention there is provided an electronic mailbox system comprising (a) a mailbox housing comprising: (i) an inner cavity for holding a piece of mail; (ii) a lid moveable between an open position and a closed position respectively allowing and preventing access to the inner cavity; (iii) an electrically-operable lock system operatively connected to the lid, the lock system can move between a locked position which secures the lid in the closed position and an unlocked position which permits the lid to be moved to the open position; (iv) a slot disposed in the mailbox housing for accommodating the piece of mail; and (v) an emergency unlocking system comprising a tool key engagement mechanism positioned in a normally concealed location on the mailbox housing and operable to move the lock system from the locked position to the unlocked position, and (vi) an information plate mounted to an exterior of the mailbox housing and displaying readable information on a side of said information plate facing away from the mailbox housing, the information plate being mounted to the exterior of the mailbox housing by a fastening mechanism that holds the information plate in a normal position overlying the tool key engagement system for concealment of said tool key engagement system behind said information plate, the fastening mechanism being selectively operable to remove the logo plate from the normal position overlying said tool key engagement mechanism to reveal access to the tool key engagement mechanism According to a second aspect of the invention there is provided an electronic mailbox system comprising (a) a mailbox housing installed in an outdoor environment and comprising: (i) an inner cavity for holding a piece of mail; (ii) a lid moveable between an open position and a closed position respectively allowing and preventing access to the inner cavity; (iii) an electrically-operable lock system operatively connected to the lid, the lock system can move between a locked position which secures the lid in the closed position and an unlocked position which permits the lid to be moved to the open position; (iv) a slot disposed in the mailbox housing for accommodating the piece of mail; (v) a mail sensor for detecting the piece of mail being inserted into the slot; (vi) a first transmitter and a first receiver; and (vii) a mailbox microprocessor operatively connected to each of the mail sensor, the lock system, the first transmitter, and the first receiver; and (b) a control box installed separately from the mailbox housing in an indoor environment and comprising: (i) a second transmitter and a second receiver, wherein the second receiver is configured to receive signals from the first transmitter and the first receiver is configured to receive signals from the second transmitter; (ii) a control box indicator light; (iii) an unlock button; and (iv) a control box microprocessor operatively connected to each the second transmitter, the second receiver, the control box indicator light, the unlock button, and the reset button; wherein the mailbox microprocessor is configured to receive a first sensor input signal from the mail sensor when the mail sensor detects the piece of mail being inserted into the slot whereupon the mailbox microprocessor generates a first transmitter output command to the first transmitter to cause the first transmitter to send a first transmitter signal to the second receiver in the control box; wherein the second receiver is configured to send a second receiver input signal to the control box microprocessor when the second receiver receives the first transmitter signal from the first transmitter, whereupon the control box microprocessor generates a second light output command to the control box indicator light to cause the control box indicator light to become activated; and wherein the control box microprocessor is configured to receive a first unlock input signal from the unlock button when the unlock button is pressed whereupon the control box microprocessor generates a second transmitter output command to the second transmitter to cause the second transmitter to send a second transmitter signal to the first receiver in the mailbox housing; wherein the first receiver is configured to send a second unlock input signal to the mailbox microprocessor when the first receiver receives the second transmitter signal from the second transmitter, whereupon the mailbox microprocessor generates an unlock output command to the lock system to cause the lock system to move to the unlocked position.

According to yet another aspect of the invention there is provided an electronic mailbox system comprising (a) a mailbox comprising: (i) a housing having an inner cavity for holding a piece of mail; (ii) a lid moveable between an open position and a closed position respectively allowing and preventing access to the inner cavity; (iii) an electrically-operable lock system operatively connected to the lid, the lock system being movable between a locked position which secures the lid in the closed position and an unlocked position which permits the lid to be moved to the open position; (iv) a slot disposed in the mailbox housing for accommodating the piece of mail through the slot and into the inner cavity; (v) a mail sensor for detecting the piece of mail inserted into the cavity through the slot; (vi) a first transmitter and a first receiver; and (vii) a first processor operatively connected to each of the mail sensor, the lock system, the first transmitter, and the first receiver; and (b) a handheld mobile device comprising (i) a second transmitter and a second receiver; (ii) at least one output device; (iii) at least one input device; and (iv) a second processor operably connected to the second transmitter, the second receiver, the output device, and the input device; wherein the first processor at the mailbox is arranged to (i) in response to an internal mail received signal generated by the mail sensor upon receipt of the piece of mail in the inner cavity, transmit an external mail received signal from the first transmitter; and (ii) in response to receipt of an external unlock signal by the first receiver, send an internal unlock signal to the electrically-operable lock to effect movement thereof to the unlocked position; and wherein second processor is arranged to (i) in response to receipt of an incoming mail received signal at the second receiver, generating a received mail alert via the at least one output device of the handheld mobile device; and (ii) in response to an unlock command received from a user via the input device, transmitting an outgoing unlock signal from the second transmitter of the handheld mobile device.

The mailbox may comprise a newspaper holder situated outside the inner cavity of the mailbox housing and a newspaper sensor connected to the first processor and operable to detect placement of a newspaper on said newspaper holder, the first processor at the mailbox being arranged to have the first transmitter transmit an external newspaper received signal in response to an internal newspaper received signal from the newspaper sensor, and the second processor at the handheld mobile device being arranged to generate a received newspaper alert via the at least on output device of the handheld mobile device in response to an incoming newspaper received signal received by the second transmitter.

The mailbox may comprises a tamper sensor connected to the first processor and operable to detect tampering of the mailbox housing, the first processor at the mailbox being arranged to have the first transmitter transmit an external mailbox tamper signal in response to an internal mailbox tamper signal from the newspaper sensor, and the second processor at the handheld mobile device being arranged to generate a mailbox tamper alert via the at least one output device of the handheld mobile device in response to an incoming mailbox tamper signal received by the second transmitter.

The mailbox may comprise an image capture device operable to capture images at a location of the mailbox, the image capture device being arranged to activate in response to the internal tamper signal to record at least one image of a tampering event.

The first transmitter may be arranged to transmit image data reflective of said recorded image to a remote location.

Preferably the at least one output device of the handheld mobile device comprises a display screen, and the second receiver may be arranged to receive the image data for display of said recorded image on the display screen.

Preferably the alerts are different and distinct from one another.

Each alert may comprise a visual alert displayed on said display screen.

Preferably the at least one output device comprises a speaker, and each alert may comprise an audible alert sounded from said speaker.

There may be provided a server connected to a network to which the mailbox and the handheld mobile device are also connected, wherein the server is arranged to receive the external mail received signal from the mailbox and, in response thereto, send the incoming mail received signal to the handheld mobile device; and to receive the outgoing unlock signal from the handheld mobile device and, in response thereto, send the external unlock signal to the mailbox.

Preferably the handheld mobile device comprises computer readable memory having a software application stored thereon for execution by the processor.

The software application may include an authentication routine arranged to receive an authentication code associated with the mailbox and transmit an outgoing authentication code signal to a remote server having a database containing a collection of authentication codes for multiple mailboxes, the server being arranged to compare said authentication code against the collection of authentication codes, and in response to finding a match for said authentication code, authorize control of the mailbox by the handheld mobile device.

Preferably the handheld mobile device comprises a microphone, and the software application may include a voice recognition function operable to detect a verbal unlock command received from the microphone and, in response to said verbal unlock command, transmit the outgoing unlock signal from the second transmitter of the handheld mobile device.

The mailbox may comprise an auto-lock mechanism operable to move lock system to the locked position after a predetermined length of time after the lock system has been moved to the unlocked position, in which case the software application may include a timer display routine operable show a timer countdown on the display screen for counting down the predetermined length of time in response to movement of the lock system to the unlocked position.

The timer display routine is preferably arranged for early termination of the timer countdown before expiry of the predetermined length of time in response to receipt of the unlock command from the input device prior to said expiry of the predetermined length of time.

There may be provided multiple handheld mobile devices, each operable to control the lock system of the mailbox, in which case each handheld mobile device is preferably arranged to receive said incoming mail received signal and generated a respective mail received alert in response to same.

The mailbox may comprise a location determining device operable to determine a location of the mailbox and generate a locating signal containing location data on said location for transmission of said data from the mailbox, in which case the software application may include a tracking function operable to receive an incoming location signal containing said location data and show a map on the display screen together with a positional marker displayed on said map at a position thereon according to the location data, whereby the user can track the location of the mailbox if stolen from an originally installed location of said mailbox.

Preferably the handheld mobile device is a mobile phone or tablet computer.

According to yet a further aspect of the invention, there is provided a method of managing receipt of physical mail at a mailbox, the method comprising:

at the mailbox, in response to receipt of a piece of mail in an inner cavity of the mailbox through a slot of said mailbox, transmitting an external mail received signal to a remote location;

on a handheld mobile device at the remote location, receiving an incoming mail received signal based on said external mail received signal transmitted from the mailbox, and in response to receipt of said incoming mail signal, generating a mail received alert and conveying said mail received alert to a user of said mobile handheld device;

after departure of the user of the mobile handheld device from the remote location and arrival of said user at a site of the mailbox, receiving an unlock command at the mobile handheld device from the user through an input device of said mobile handheld device, and in response to said unlock command, sending an outgoing unlock signal from the mobile handheld device;

at the mailbox, based on the outgoing unlock signal from the mobile handheld device, sending an internal unlock signal to a locking system of the mailbox to unlock a lid of the mailbox to enable manual access to the inner cavity thereof; and after removal of the piece of mail from the inner cavity of the mailbox and re-closing of the lid of said mailbox, sending a lock signal to the locking system in order to re-lock the lid of the mailbox to securely enclose the inner cavity thereof.

BRIEF DESCRIPTION OF THE DRAWINGS

Specific embodiments of the invention will now be described, purely by way of example, with reference to the drawings, in which:

FIG. 12 is a rear perspective view of the mailbox housing of FIG. 11.

FIG. 13 is an alternative embodiment of a control box of the system of the present invention.

DETAILED DESCRIPTION

Referring now to FIG. 1-23, the present invention features an electronic mailbox system 100 for providing a secure environment for receiving mail.

Figure 1:
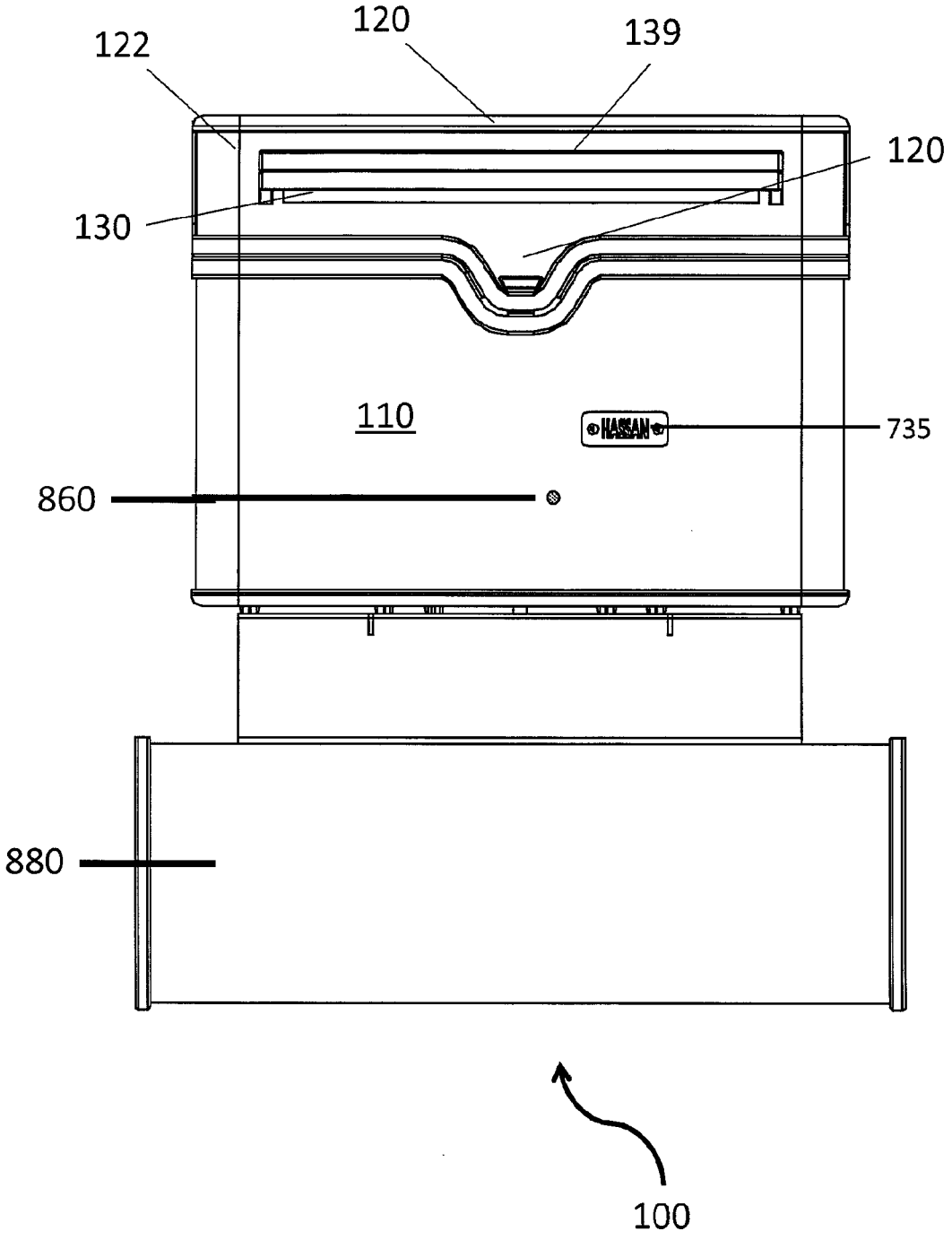
FIG. 1 is a front view of a mailbox housing of the system of the present invention.

As shown in FIG. 1, the electronic mailbox system 100 comprises a mailbox housing 110 having a first side, a second side, a front surface, a back surface, a bottom surface, and an inner cavity for holding mail. A lid 120 (e.g. "output door") is pivotally attached to the mailbox housing 110 (e.g., the back surface, a top surface). The lid 120 (e.g. "output door") can move between an open position and a closed position respectively allowing and preventing access to the inner cavity of the mailbox housing 110.

In some embodiments, a newspaper holder 880 is disposed on the mailbox housing 110, for example on the bottom surface (or other portion) of the mailbox housing 110. A newspaper can be attached or inserted into to the newspaper holder 880.

Disposed in the front surface of the mailbox housing 110 is a slot 130. The slot 130 allows mail to be inserted into the mailbox housing 110. In some embodiments, the front surface of the mailbox housing 110 comprises an awning 139 positioned over the slot 130 (covering the slot 130) to help prevent moisture (e.g., rain, snow, etc.) from entering into the slot 130.

In some embodiments, an inner door covers the slot 130 in the front surface of the mailbox housing 110. The inner door may be attached to the inside surface of the front surface of the mailbox housing 110 such that it covers the slot 130. The inner door is moveable between an open position and a closed position, and the inner door is biased in the closed position caused by a spring. The inner door can help to prevent dirt, rain, or snow from leaking into the mailbox housing 110.

Figure 2:
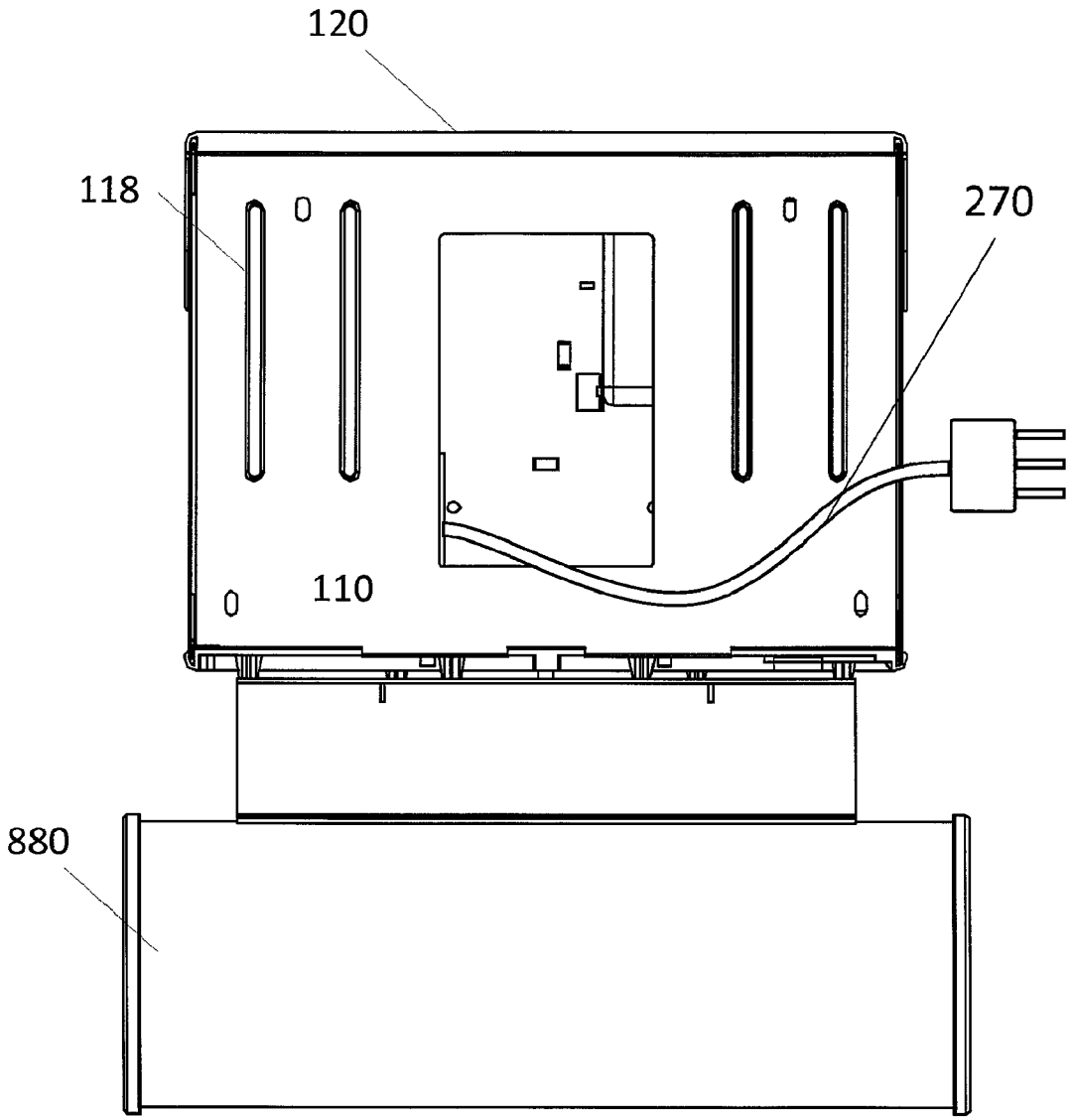
FIG. 2 is a rear view of the mailbox housing of FIG. 1.

Referring now to FIG. 2, one or more mounting holes 118 (or mounting slots) are disposed on the back surface of the mailbox housing 110. The mounting holes 118 are for allowing a user to mount the mailbox housing 110 on a wall or similar surface.

Figure 3:
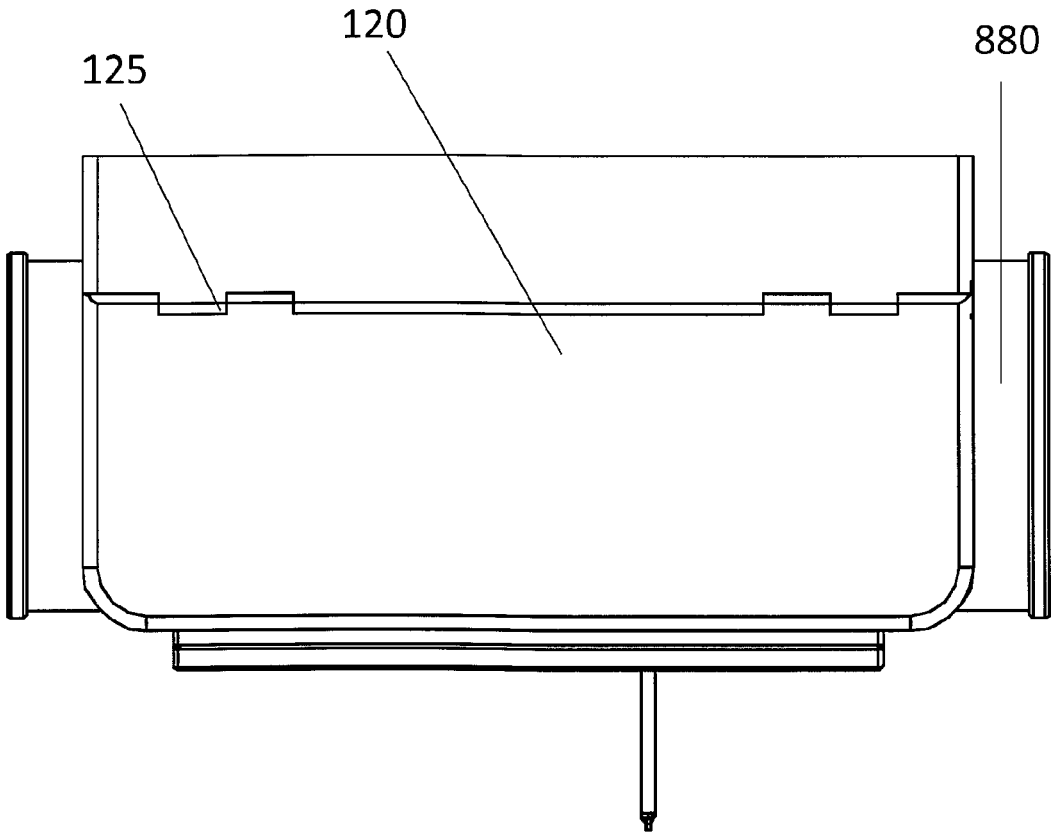
FIG. 3 is a top view of the mailbox housing of FIG. 1.
Figure 4:
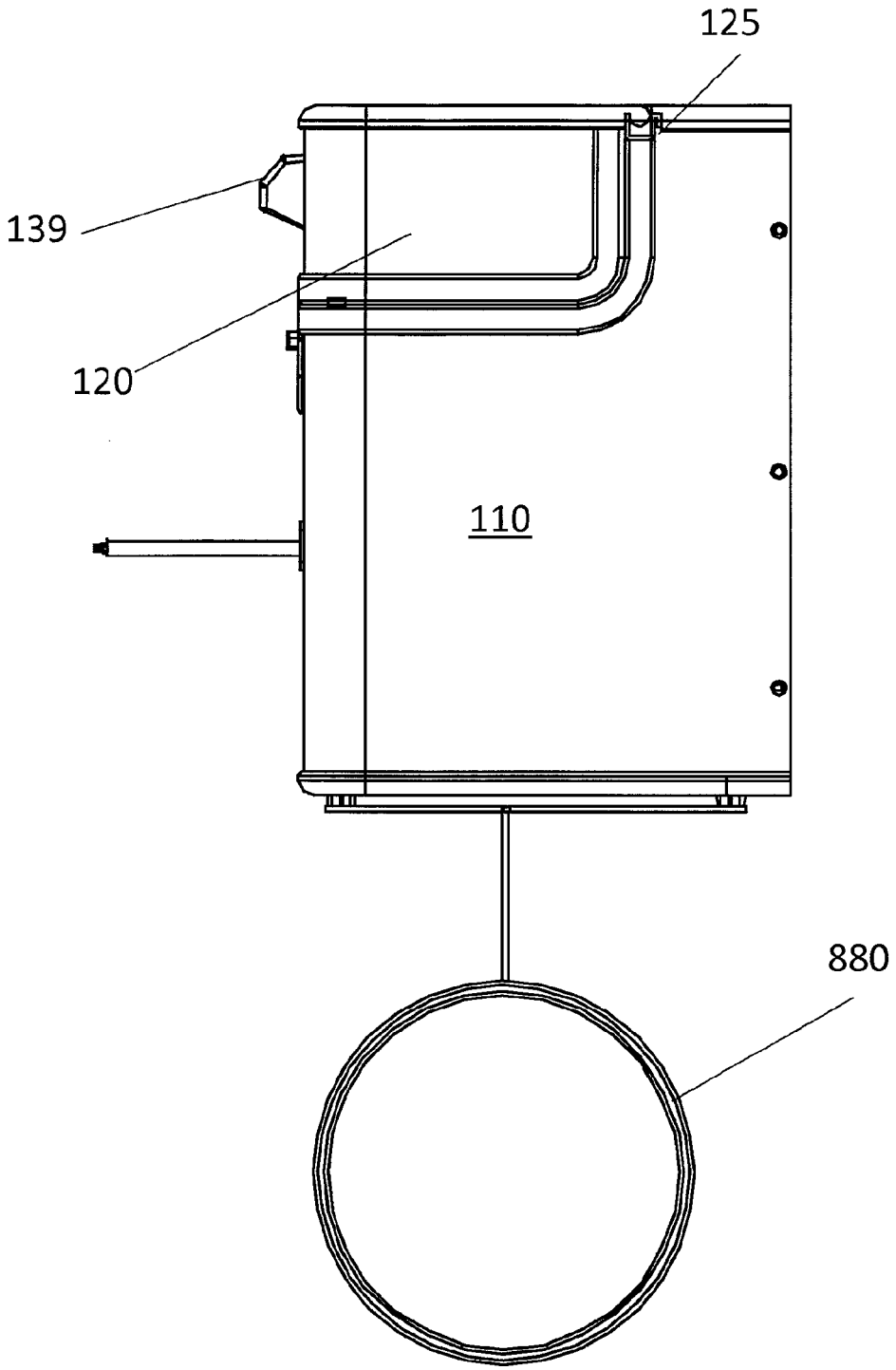
FIG. 4 is a side view of the mailbox housing of FIG. 1.
Figure 4A:
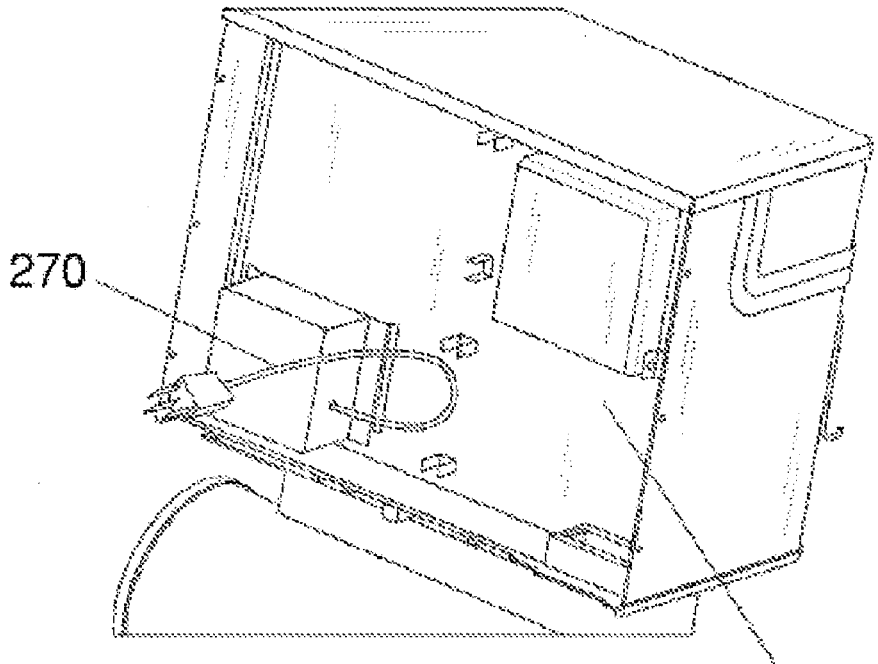
FIGS. 4A & 4B are both rear views of the mailbox housing comprising a power cord.
Figure 4B:
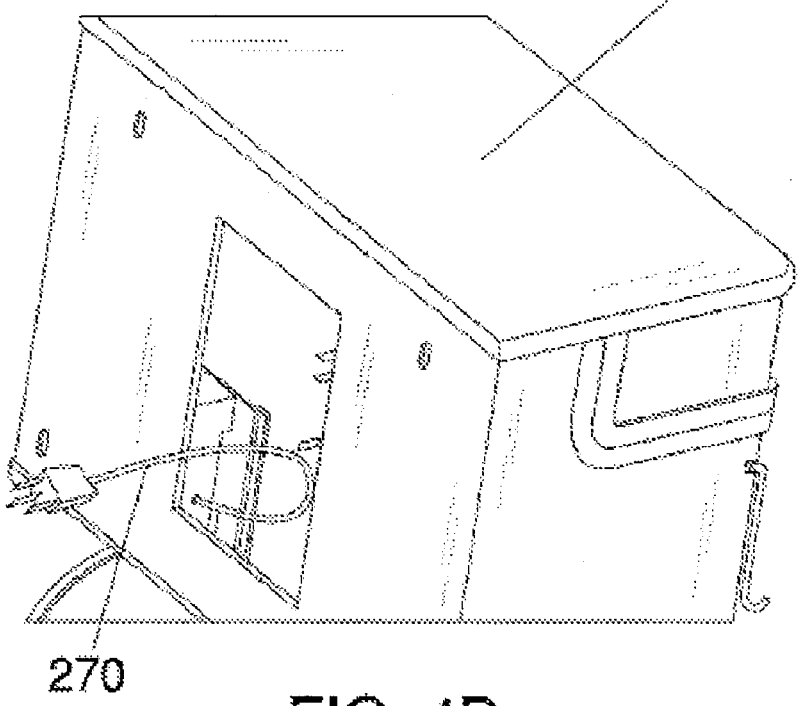

As shown in FIG. 3 and FIG. 4, the lid 120 (e.g. "output door") may be pivotally attached to a top surface of the housing 110 (e.g., via a hinge 125).

The lid 120 (e.g. "output door") can be locked in the closed position via a lock system. The lock system may be an electronic or electromagnetic lock, and such electronic and electromagnetic locks are well known to one of ordinary skill in the art. The lock system is operatively connected to a power source. The lock system can move between an unlocked position and a locked position respectively allowing and preventing access to the inner cavity of the mailbox housing 110. In some embodiments, the lock system is disposed inside the mailbox housing (e.g., on the front surface of the housing) and the lock system is operatively connected to the lid 120 (e.g. "output door").

In some embodiments, a good lock indicator light 860 (e.g., "GOOD LOCK LED") is disposed on the mailbox housing 110 (e.g., the front surface) and operatively connected to the lock system. When the lid 120 is locked correctly, the good lock indicator light 860 is activated (e.g., LED stays on GREEN). If not, the good lock indicator light is not turned on. This helps the user to ensure to the lid 120 is locked appropriately after the mail is retrieved.

A mailbox microprocessor is disposed in the mailbox housing 110. The mailbox microprocessor is operatively connected to an optical sensor. Optical sensors are well known to one of ordinary skill in the aft. The optical sensor is for detecting when a piece of mail is inserted into the mailbox housing 110 via the slot 130. The mailbox microprocessor is also operatively connected to a first transmitter, a first receiver, and the lock system. The mailbox microprocessor may be operatively connected to the various components (e.g., lock system, optical sensor, etc.) via one or more circuit boards (e.g., a printed circuit board, see FIG. 5, FIG. 6)

The mailbox microprocessor is configured to receive a first sensor input signal from the optical sensor when it detects mail has been placed in the mailbox housing 110. Upon receipt of the first sensor input signal the mailbox microprocessor is configured to generate a first transmitter output command to the first transmitter. Upon receipt of the first transmitter output command, the first transmitter is configured to transmit a first transmitter signal to a second receiver in a control box 210 (see FIG. 17A).

In some embodiments, the mailbox microprocessor is operatively connected to a mailbox indicator light disposed on the housing 110 (see FIG. 1). In some embodiments, when the mailbox microprocessor receives the first sensor input signal the mailbox microprocessor generates a first light output command to the mailbox indicator light to activate the mailbox indicator light (see FIG. 17C).

Figure 5:
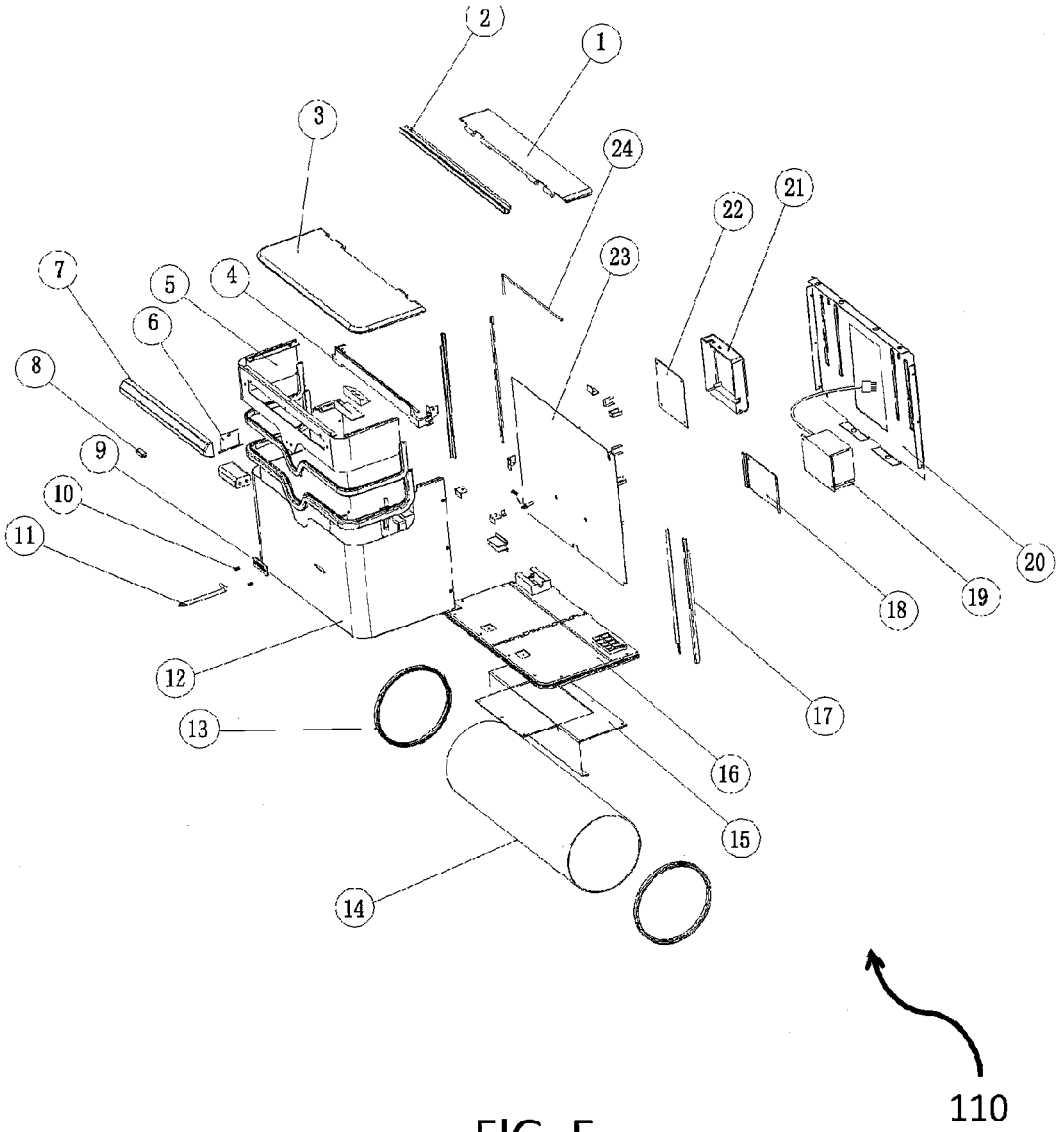
FIG. 5 is a front exploded view of the mailbox housing of FIG. 1.
Figure 6:
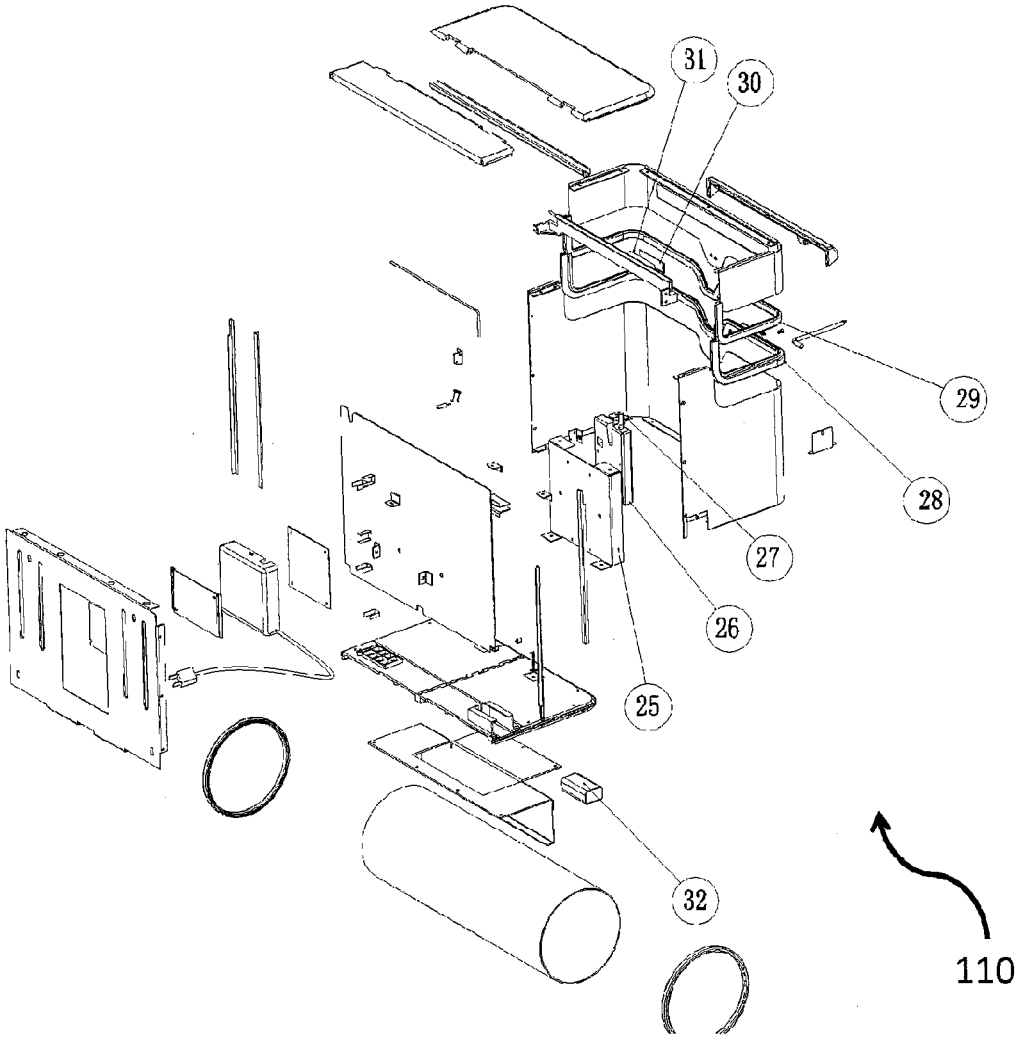
FIG. 6 is a rear exploded view of the mailbox housing of FIG. 1.

FIG. 5 and FIG. 6 are exploded views of an embodiment of the system 100 of the present invention. The mailbox housing 110 shown comprises a top surface 1, a water proof piece 2, a lid 3, an inner door 4, a top metal plate 5 (portion of the front surface and sides of the housing), a battery door 6, an awning 7, a holder 8, a nameplate 9 for attaching to the mailbox housing, a screw 10 for the nameplate 9, a tool key 11, a bottom metal plate 12 (portion of the front surface and sides of the housing), a plastic ring 13 for the newspaper holder 14, a newspaper holder 14, a newspaper holder bracket 15 (for attaching the newspaper holder 14 to the housing), a bottom surface 16, a baffle side plate 17, a support AC board 18, an adapter 19 to which a power cord (e.g., AC power cord is attached), a back surface 20, a printed circuit board (PCB) cover 21, a printed circuit board (PCB) 22, a baffle plate 23, an antenna 24, an L-lock cover 25, an electrical lock 26, a L-Lock hook 27, a rubber ring bottom 28, a rubber ring top 29, an L-hook container 30, an L-hook plate 31, a battery 32.

Control Box

Figure 8:
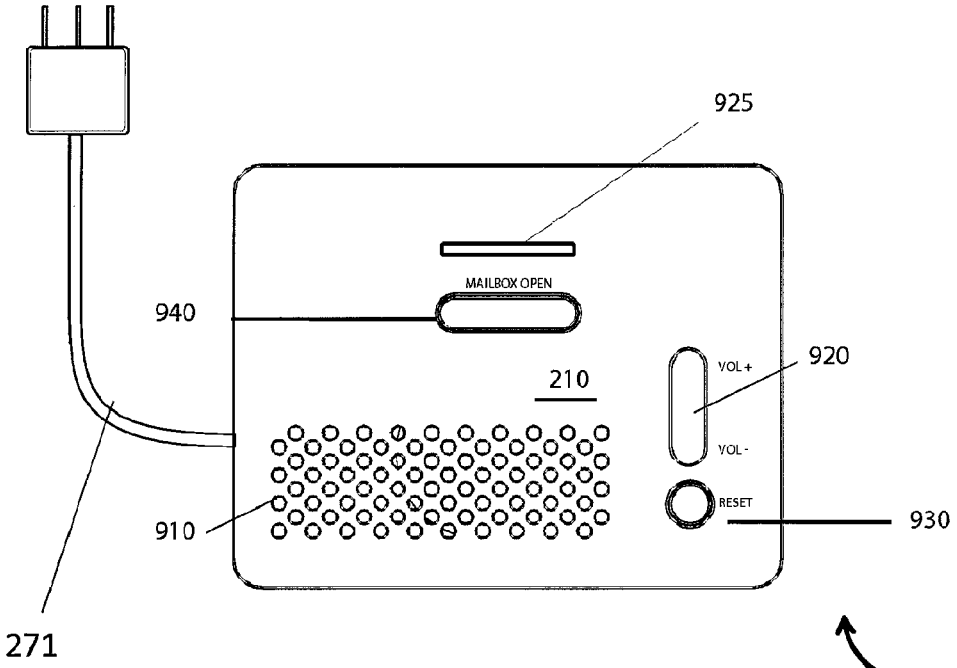
FIG. 8 is a front view of a control box of the system of the present invention.
Figure 9:
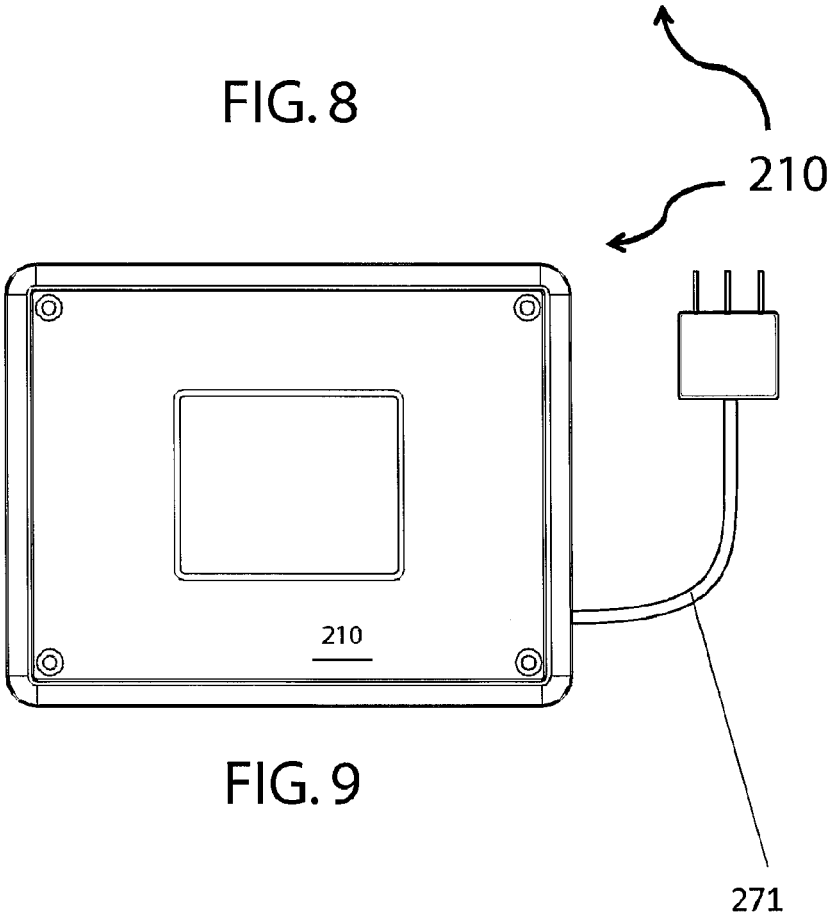
FIG. 9 is a rear view of the control box of FIG. 8.
Figure 10:
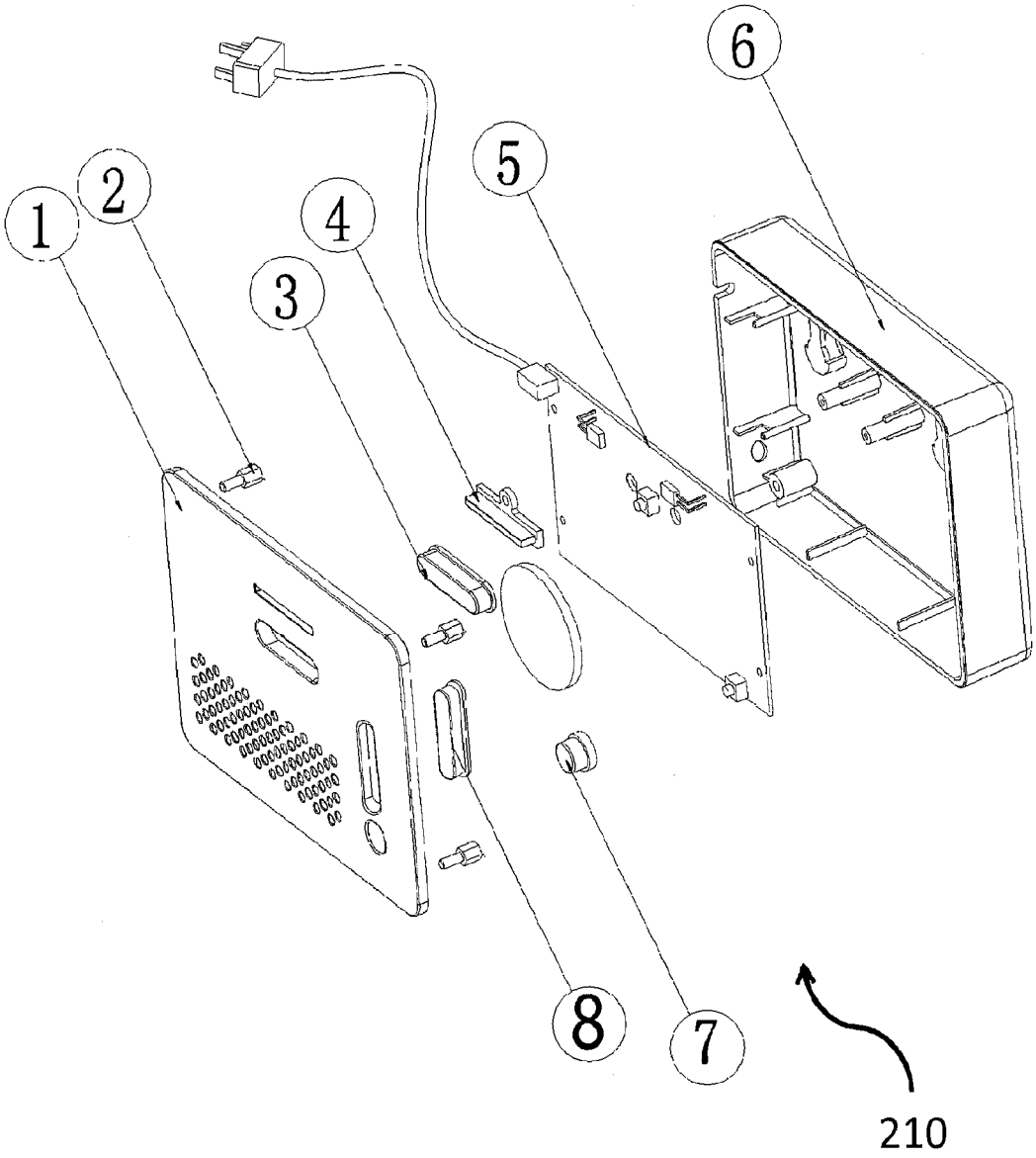
FIG. 10 is an exploded view of the control box of FIG. 8.
Figure 11:
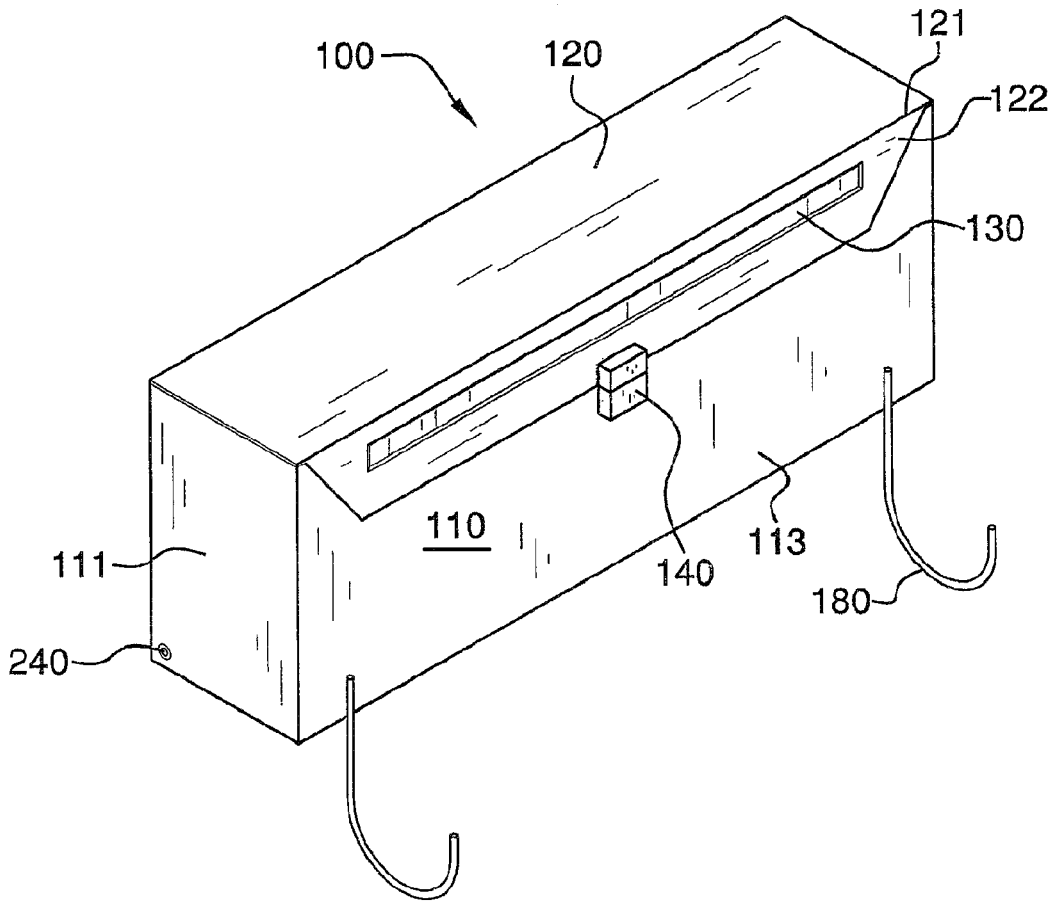
FIG. 11 is a front perspective view of an alternative embodiment of a mailbox housing of the system of the present invention.
Figure 14:
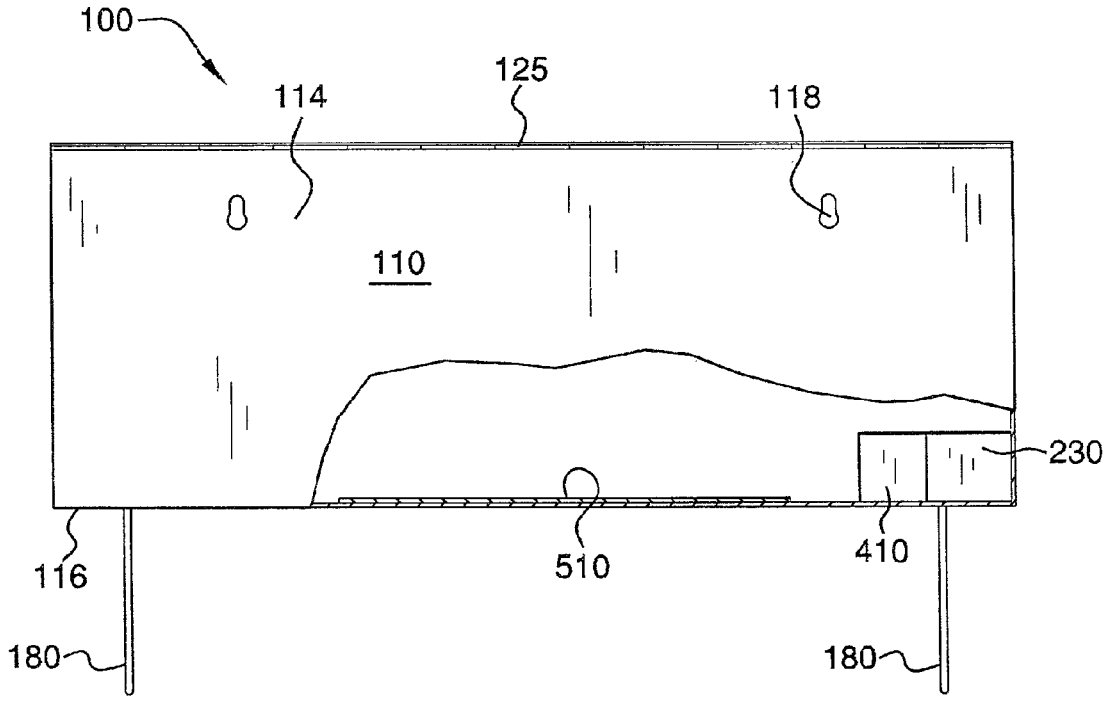
FIG. 14 is a rear and partial internal view of the mailbox housing of FIG. 11.
Figure 15:
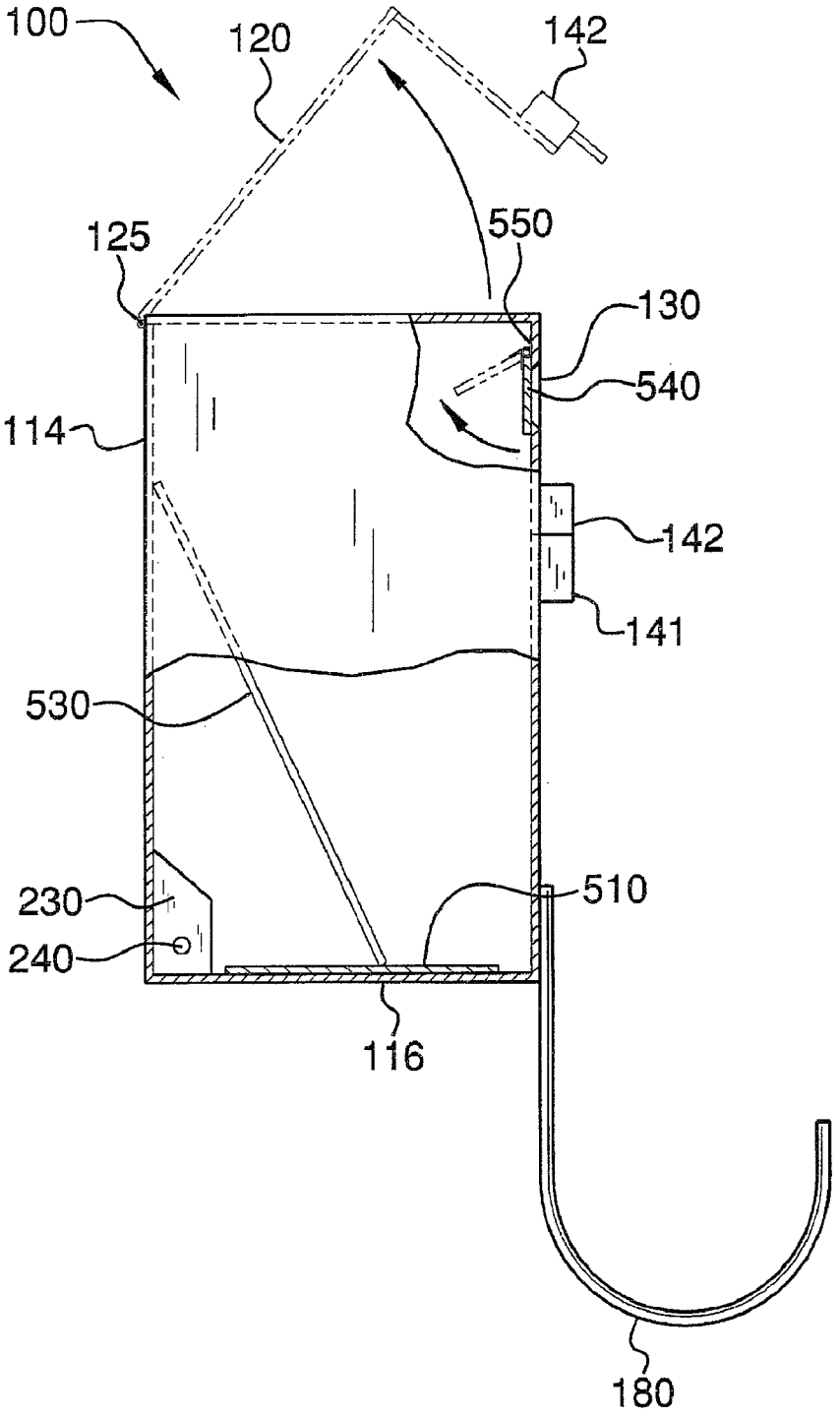
FIG. 15 is a side cross sectional view of the mailbox housing of FIG. 11.
Figure 16:
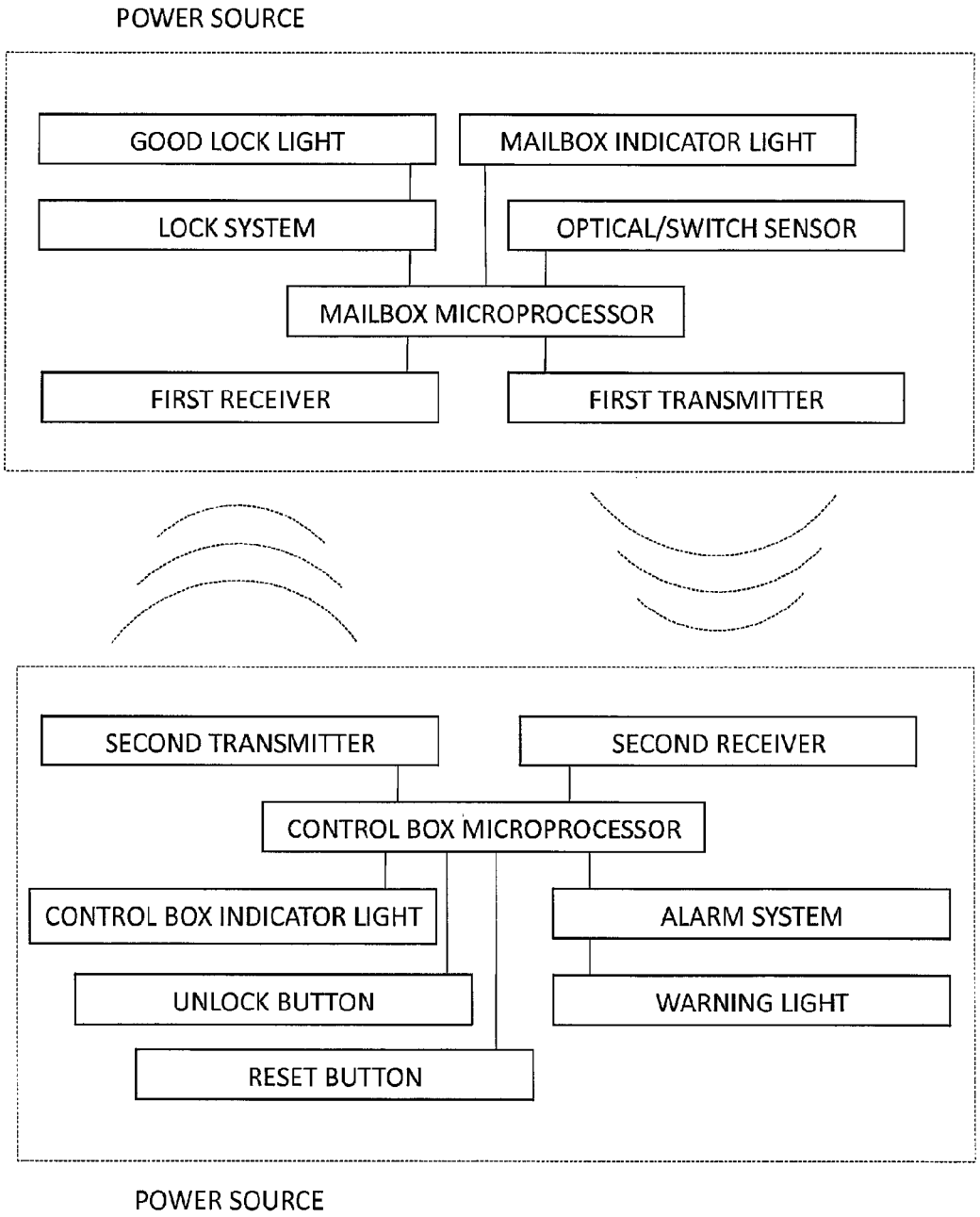
FIG. 16 is a schematic representation of electrical components of the control box and mailbox housing in the system of the present invention.

Referring now to FIG. 8-10, the control box 210 may be placed a certain distance away from the mailbox housing 110 (e.g., in the home of the user). The control box 210 has a front surface, a back surface, a first side, a second side, a top surface, a bottom surface, and an inner cavity. Disposed in the control box 210 is a control box microprocessor operatively connected to the second receiver and to a second transmitter. The control box 210 is operatively connected to a control box indicator light 925. In some embodiments, the control box microprocessor is operatively connected to an alarm system (with speaker 910), which functions to alert a user that mail has been delivered to the mailbox housing 110.

The second receiver is configured to send a second receiver input signal to the control box microprocessor when the second receiver receives the first transmitter signal from the first transmitter. When the control box microprocessor receives the first transmitter signal from the second receiver, the control box microprocessor generates a second light output command to the control box indicator light to activate the control box indicator light (see FIG. 17A). This can alert the user that mail has arrived in the mailbox housing.

Figure 17A:
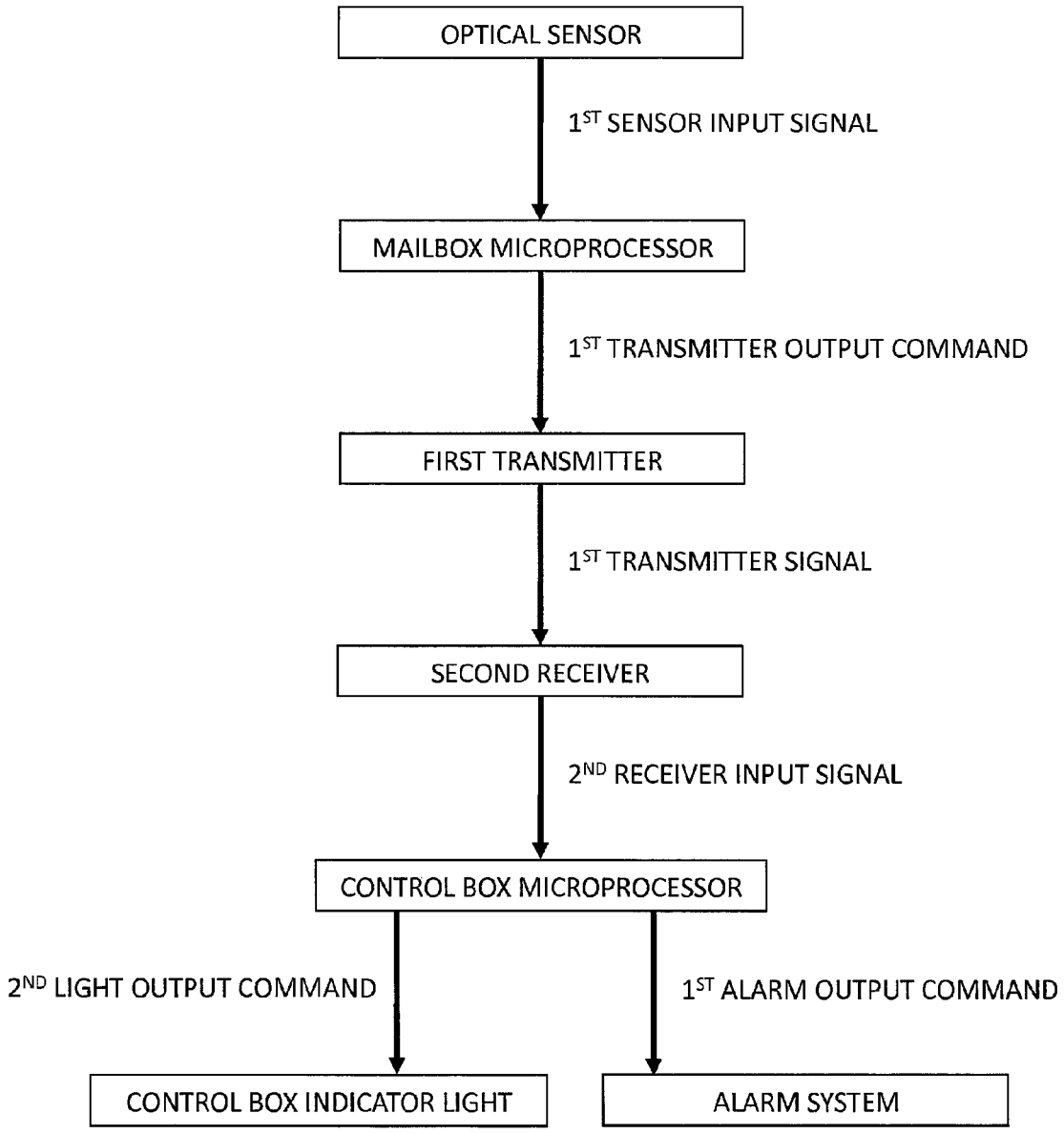
FIG. 17A-E are schematic representations of input signals and output commands of the system of the control box and mailbox housing in the present invention.
Figure 17B:
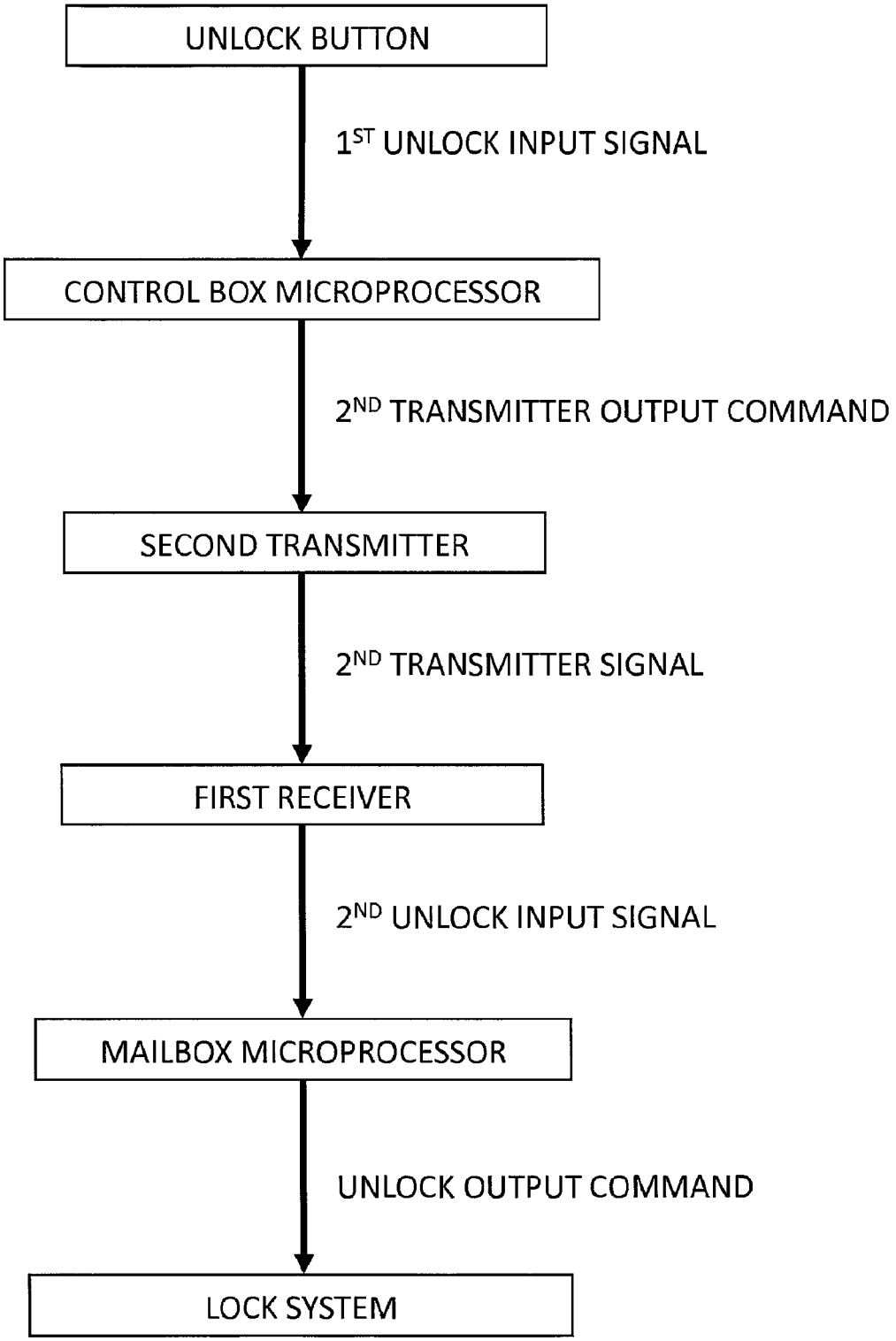
Figure 17C:
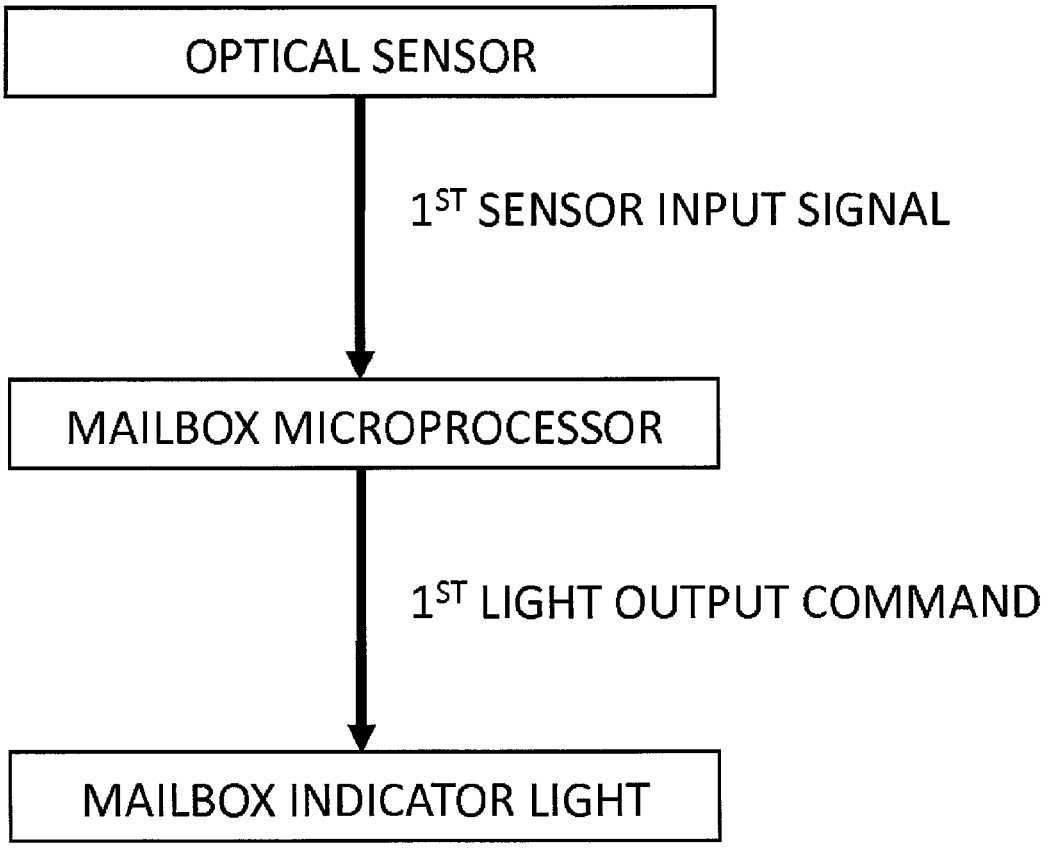
Figure 17D:
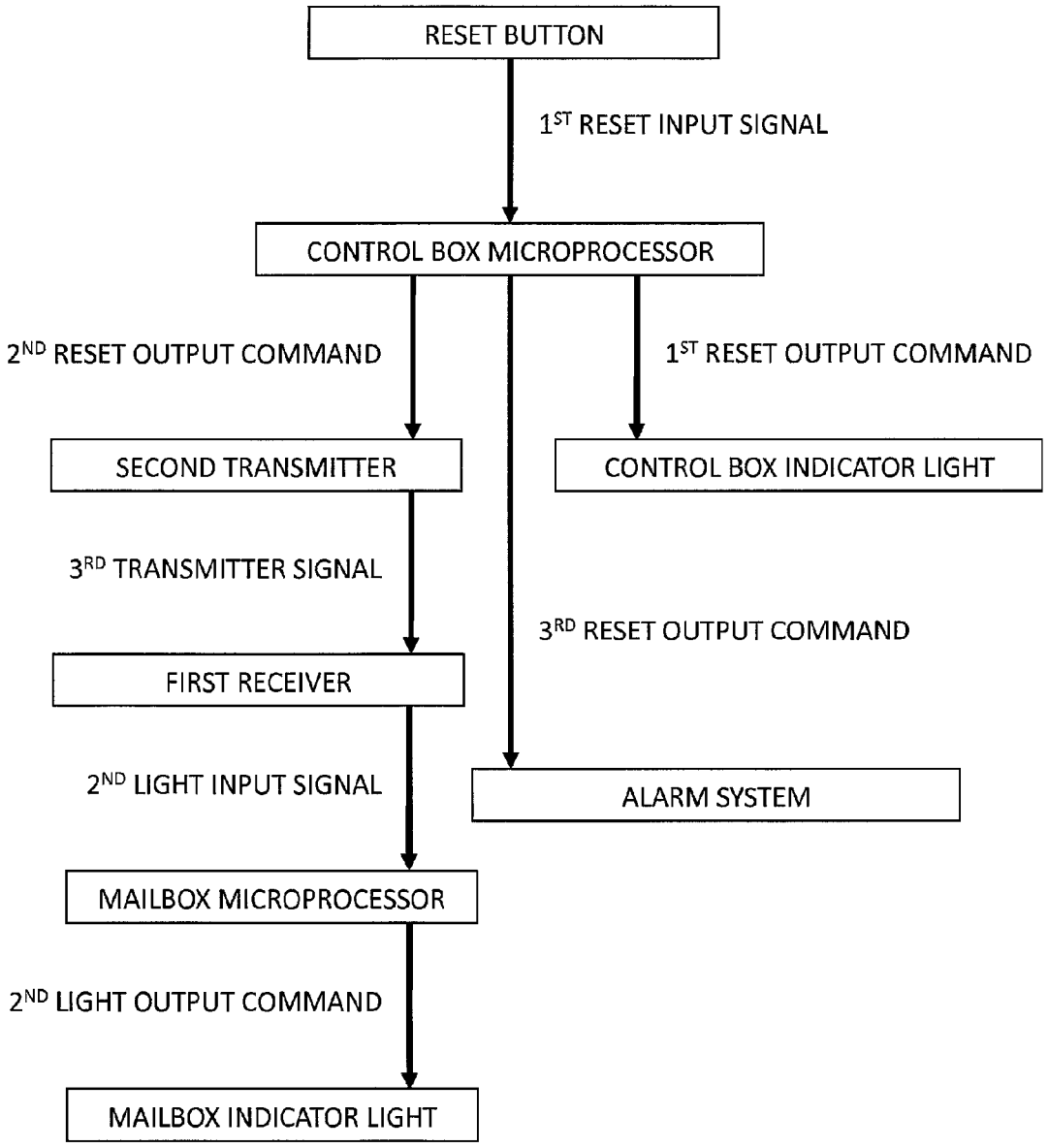
Figure 17E:
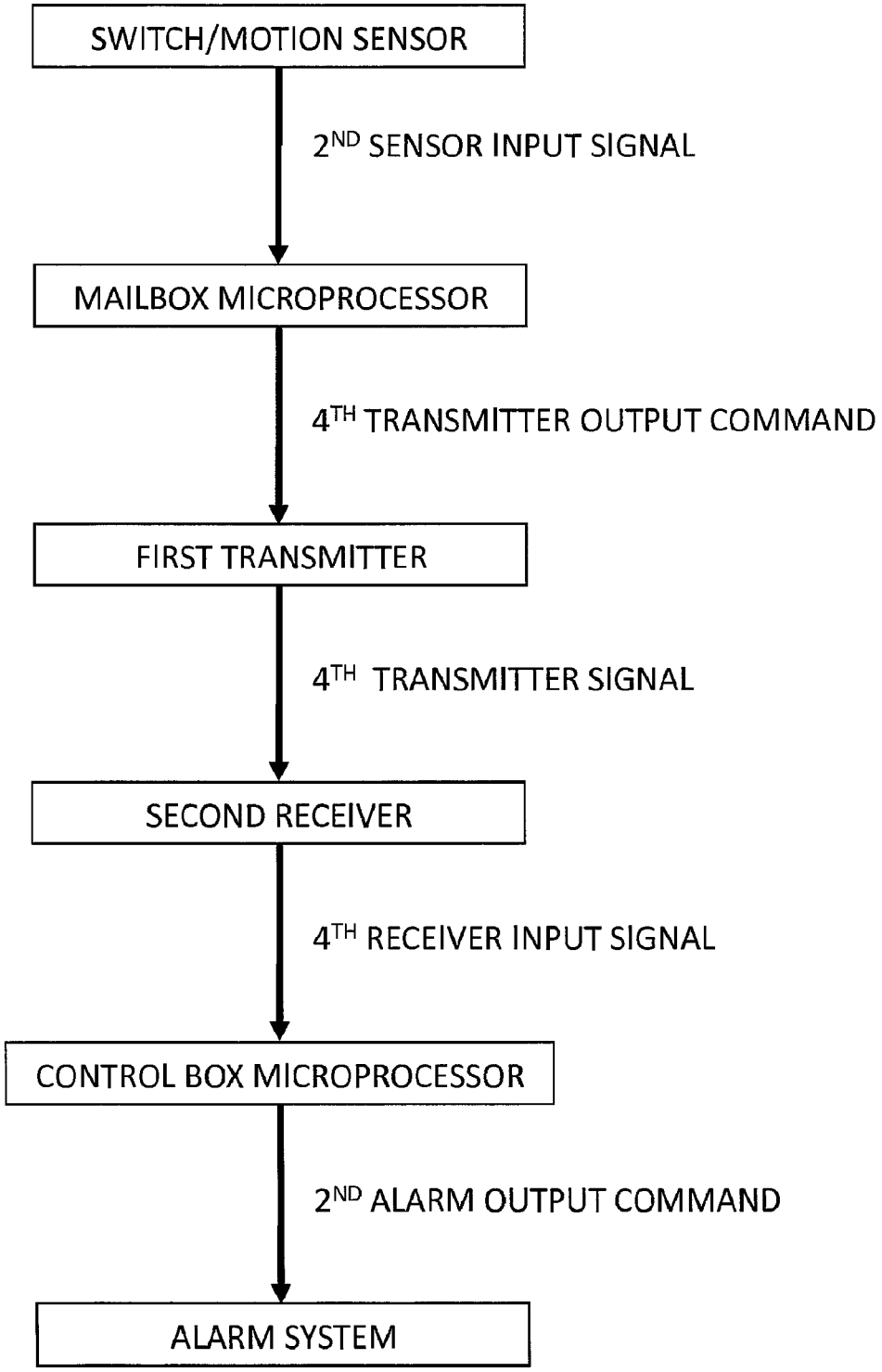
Figure 18:
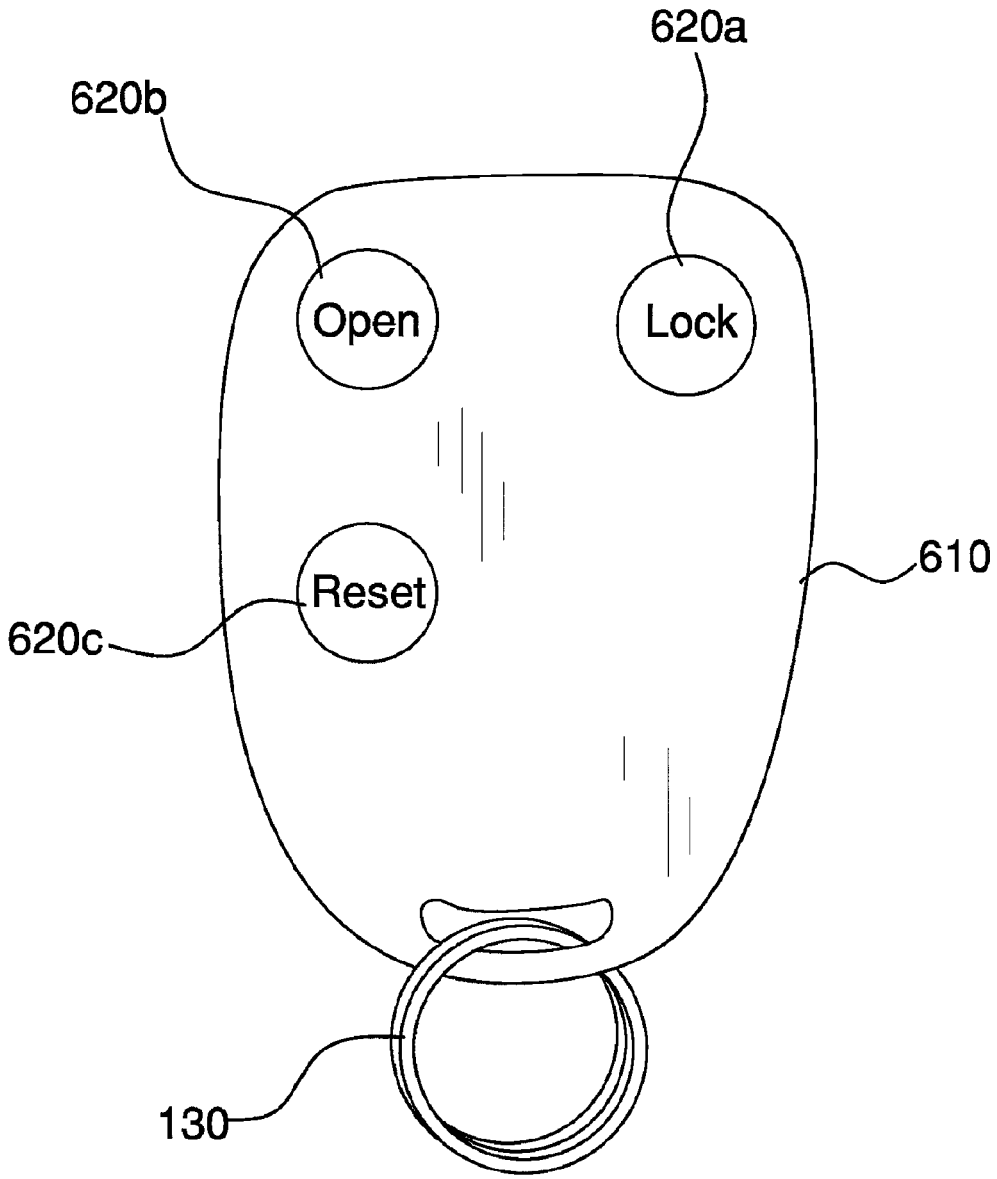
FIG. 18 is a front view of an example of a remote control for the system of the present invention.
Figure 19:
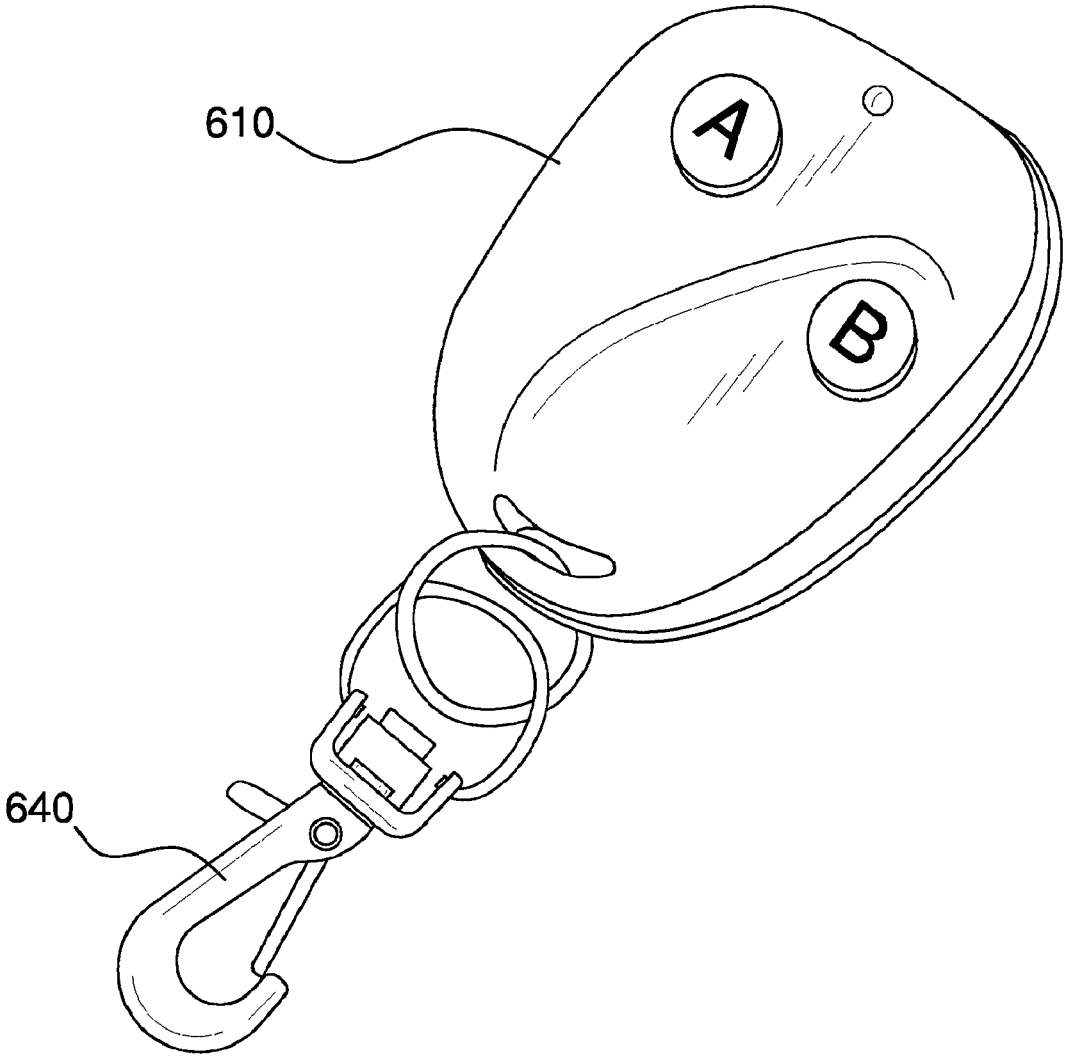
FIG. 19 is a perspective view of an alternative example of a remote control for the system of the present invention.

In some embodiments, upon receipt of the second receiver input signal, the control box microprocessor is configured to generate a first alarm output command to the alarm system to activate the alarm system (see FIG. 17A).

In some embodiments, the control box microprocessor is operatively connected to an unlock button 940 (e.g., disposed on the front surface of the control box) for unlocking the lock system on the mailbox housing. For example, the control box microprocessor is configured to receive a first unlock input signal from the unlock button 940 and generate a second transmitter output command to the second transmitter. The second transmitter is configured to send a second transmitter signal to the first receiver in the mailbox housing 110. When the first receiver receives the second transmitter signal, the first receiver sends a second unlock input signal to the mailbox microprocessor. Upon receipt of the second unlock input signal, the mailbox microprocessor generates an unlock output command to the lock system so as to unlock the lock system (see FIG. 17B).

In some embodiments, the unlock button 940 comprises a keypad system, wherein a user can pre-program a unique code for unlocking the lock system. Such keypad systems for unlocking other systems are well known to one of ordinary skill in the art.

In some embodiments, the microprocessor is operatively connected to a reset button 930. Reset buttons are well known to one of ordinary skill in the art. For example, in some embodiments, the control box microprocessor is configured to receive a first reset input signal from the reset button when the reset button is pressed. Upon receipt of the first reset input signal, the control box microprocessor can generate a first reset output command to the control box indicator light to cause the control box indicator light to become deactivated (see FIG. 17D).

In some embodiments, when the control box microprocessor receives the first reset input signal the control box microprocessor generates a second reset output command to the second transmitter to cause the second transmitter to send a third transmitter signal to the first receiver. Then, the first receiver can send a second light input signal to the mailbox microprocessor, whereupon the mailbox microprocessor generates a second light output command to the mailbox indicator light to deactivate the mailbox indicator light (see FIG. 17D).

In some embodiments, when the control box microprocessor receives the first reset input signal the control box microprocessor generates a third reset output command to the alarm system to deactivate the alarm system.

In some embodiments, one or more volume buttons 920 are disposed on the control box 210. The volume buttons 920 regulate the volume of the alarm system, for example.

The control box microprocessor may be operatively connected to the various components (e.g., second transmitter, alarm system, etc.) via one or more circuit boards (e.g., a printed circuit board, see FIG. 10)

The control box 210 may be placed on a table (e.g., in a living room). The control box 210 may be plugged into an electrical outlet via a second power cord 271 (see FIG. 9). The present invention is not limited to this arrangement. For example, in alternative embodiments, one or more mounting holes (or mounting slots) are disposed on the control box (e.g., the back surface), which allow the control box to be mounted on a surface such as a wall, etc. The control box is installed in a secure indoor environment within the home, apartment building, office building or other dwelling at which the mailbox is to be used. The mailbox itself is separately in a different environment, for example outdoors in the context of a residential house application, or in a common lobby of an apartment or office building.

FIG. 10 shows an exploded view of a control box 210 comprising a front surface 1, a hex pin 2, a reset button 3, a LED lens 4 (of the reset button 3), a printed circuit board (PCB) monitor 5, a back surface 6 (of the control box), an unlock button 7, and volume buttons 8.

The system 100 of the present invention (e.g., the mailbox housing 110 and/or the control box 210) may be constructed from a variety of materials. For example, in some embodiments, the mailbox housing 110 and/or control box 210 is constructed from a material comprising a metal, a plastic, wood, the like, or a combination thereof.

The components of the system (e.g., mailbox microprocessor, control box microprocessor, alarm system, indicator lights, transmitters, receivers, etc.) may be powered by a power source, for example a battery or an electrical outlet. FIG. 2, FIG. 4A, FIG. 4B, FIG. 5, and FIG. 6 show the mailbox comprising a first power cord 270. FIG. 8, FIG. 9, and FIG. 10 show the control box 210 comprising a second power cord 271. In some embodiments, the battery includes a lithium battery.

To use the system 100 of the present invention, the system 100 is first installed. For example, the AC socket of the control box 210 is plugged in to provide power to the control box 210 and the AC socket of the mailbox housing 110 is plugged in to provide power to the mailbox housing 110. When a piece of mail (e.g., postcard, regular envelope) is dropped into mailbox housing 110 via the slot 130, the control box indicator light 925 (e.g., LED light) on the control box 210 becomes illuminated to signal to the user that he/she has mail (e.g., the LED light may flash in a green color). In some embodiments, the alarm system is activated. The user can press the unlock button (e.g., labeled with "OPEN MAILBOX BUTTON"), which unlocks the lock system (e.g., the electromagnetic lock) so that the lid can be opened and the mail retrieved. The reset button can be pressed to turn the indicator light back off (or optionally the alarm system). If the user is not ready to pick the mail up immediately, the user can press the reset button to turn off the control box indicator light (e.g., the LED light). The lock system does not become unlocked.

Figure 7A:
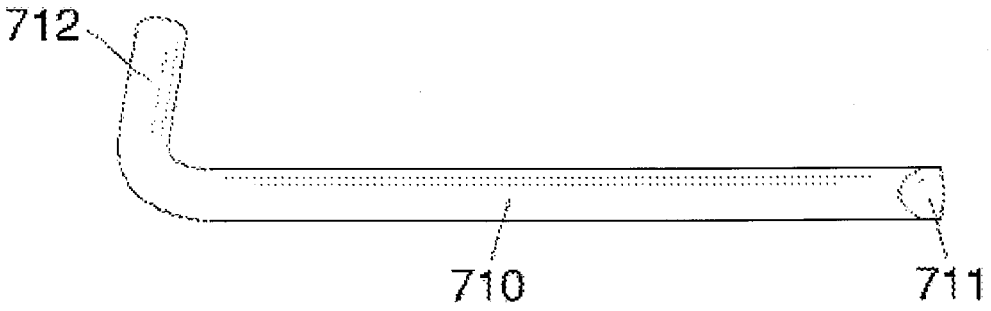
FIG. 7A is a perspective view of a tool key of the system of the present invention.
Figure 7B:
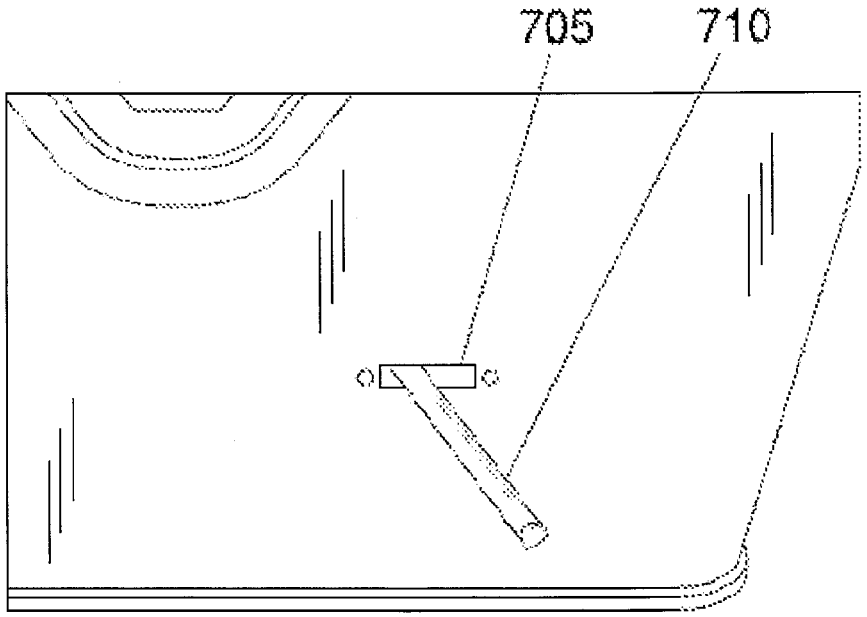
FIG. 7B is an in-use view of the tool key of the system of the present invention.

If the mailbox housing 110 needs to be unlocked in an emergency, the logo plate 735 can be removed (e.g., the screw unscrewed) via a first end 711 of a tool key 710 (see FIG. 7A, FIG. 7B). The second end 712 of the tool key 710 is inserted into a lock release hole 705 in the housing 110 covered by the logo plate. When the lock release hole 705 is reached, the key 710 can be turned clockwise to open the lock system. In some embodiments, as soon as the lid 120 is opened, the alarm system is activated. The reset button can be pressed to stop the alarm system. As shown in FIG. 1, the logo plate displays readable information on an outer face of the plate that faces away from the mailbox housing, and normally overlies the lock release hole in a position concealing the lock release hole from sight. The readable information may include one or more of a personal name of a residential owner of the mailbox, a business name or logo of a business owner of the mailbox, or a corporate name or of a manufacturer, distributer or seller of the mailbox.

In case a user presses the unlock button but does not come to pick up the mail right away, the lock system will engage an auto-lock function in a certain length of time (e.g., 10 minutes). The lock system (e.g., electromagnetic lock) will relock so the lid 120 is locked again. In some embodiments, if the lock does not become relocked, the alarm system is activated to alert the user that the lock is not locked properly.

Tampering or Theft Detection

In some embodiments, the system further comprises a switch sensor operatively connected to the mailbox microprocessor for detecting tampering (e.g., vandalism, tampering with the lock, etc.). Should someone try to vandalize the mailbox housing 110 or try to pry open lid 120 (e.g., without pressing the unlock button), then the alarm system becomes activated. In some embodiments, when the switch sensor detects tampering, the switch sensor sends a second sensor input signal to the mailbox microprocessor, whereupon the mailbox microprocessor generates a fourth transmitter output command to the first transmitter to cause the first transmitter to send a fourth transmitter signal to the second receiver. Upon receipt of the fourth transmitter signal, the second receiver sends a fourth receiver input signal to the control box microprocessor, whereupon the control box microprocessor generates a second alarm output command to the alarm system to activate the alarm system (see FIG. 17E). This alerts a user that the mailbox housing is being tampered with. In some embodiments, a warning light is illuminated on the control box 210 (see FIG. 8) if the mailbox housing is tampered with. The reset button can be pressed to turn the alarm system (and/or warning light) off.

In some embodiments, the alarm system is configured to emit various different sounds. For example, in some embodiments, the alarm system emits a first sound when the alarm system receives the first alarm output command (e.g., when mail arrives). In some embodiments, the alarm system emits a second sound when the alarm system receives the second alarm output command (e.g., if the system is being tampered with).

Alternative Embodiments

An alternative embodiment of the electronic mailbox system 100 is shown in FIGS. 11-15. For example, in some embodiments, the electronic mailbox system 100 comprises a mailbox housing 110 having a first side 111, a second side 112, a front surface 113, a back surface 114, and a bottom surface 116. A lid 120 is pivotally attached to the mailbox housing 110 via a hinge 125. The lid 120 has a front edge 121, wherein a lip 122 is perpendicularly attached such that it covers a portion of the front surface 113 of the mailbox housing 110. The lid 120 can move between an open position and a closed position via the hinge 125. Disposed in the lip 122 of the lid 120 and the front surface 130 of the mailbox housing 110 is a slot 130. The slot 130 allows mail to be inserted into the mailbox housing 110.

Disposed on the back surface 114 of the mailbox housing 110 is one or more mounting holes 118 for allowing a user to mount the mailbox housing 110 on a wall or similar surface. In some embodiments, one or more newspaper hooks 180 are attached to the bottom surface 116 (or other portion) of the mailbox housing 110. A newspaper can be attached to the newspaper hooks 180.

The lid 120 can be locked in the closed position via a lock 140. The lock 140 may be an electronic lock, and such electronic locks are well known to one of ordinary skill in the art. For example, see U.S. Pat. No. 6,107,934, the disclosure of which is incorporated in its entirety by reference herein. The lock 140 may be operatively connected to a power source (e.g., a battery).

In some embodiments, the lock 140 is attached to the lip 122 of the lid 120 and the front surface 113 of the mailbox housing 110. In some embodiments, the lock 140 comprises a male component 142 that locks into a female component 141. In some embodiments, the female component 141 is disposed on the front surface 113 of the mailbox housing 110 and the male component 142 is disposed on the lip 122 of the lid 120 (see FIG. 15). In some embodiments, the male component 142 is disposed on the front surface 113 of the mailbox housing 110 and the female component 142 is disposed on the lip 122 of the lid 120.

In some embodiments, an inner door 540 covers the slot 130 in the front surface 113 of the mailbox housing 110. The inner door 540 is attached to the inside surface of the front surface 113 of the mailbox housing 110 such that it covers the slot 130. The inner door 540 is moveable between an open position and a closed position, and the inner door 540 is biased in the closed position caused by a spring 550 attached to the inner door 540. The inner door 540 can help to prevent dirt, rain, or snow from leaking into the mailbox housing 110.

The mailbox housing 110 further comprises a mailbox microprocessor operatively connected to an optical sensor or a motion sensor 510 for detecting when a piece of mail 530 is inserted into the mailbox housing 110. The mailbox microprocessor is operatively connected to the first transmitter 410, the first receiver, and to the lock 140. The first transmitter 410 transmits signals to the second receiver in the control box 210.

The control box 210 comprises a control box microprocessor operatively connected to the second receiver and to a second transmitter. In some embodiments, the control box microprocessor is operatively connected to an alarm system with speaker 420 and to one or more control buttons 440, for example an unlock button 450 for unlocking the lock 140. In some embodiments, the control box microprocessor is operatively connected to an indicator light 430.

In some embodiments, the control buttons 440 are disposed on the front surface 213 of the control box 210. In some embodiments, the lock 140 can be unlocked via the unlock button 450.

In some embodiments, the mailbox microprocessor is operatively connected to an indicator light 430. For example, the indicator light 430 may include a light that is illuminated if mail is not present in the mailbox housing 110 and a light that is illuminated if mail is present in the mailbox housing 110. The alarm and speaker 420 and/or indicator light 430 can alert the user if a piece of mail 530 is inserted into the mailbox housing 110.

In some embodiments, the control buttons 440 may allow a user to control the volume of the alarm. In some embodiments, the control buttons 440 allow a user to reset the system.

Referring now to FIG. 18-22, the mailbox system 100 further comprises a remote control 610 for remotely operating the mailbox housing 110 and/or the control box 210. Remote control devices are well known to one of ordinary skill in the art. For example, many remote control devices are small and can be attached to other objects such as key rings via a linking component 640 (e.g., standard linking component for key rings). Disposed inside the remote control 610 is a remote control transmitter operatively connected to a remote control microprocessor. Remote control buttons are disposed on the remote control 610, for example a remote lock mailbox button 620*a*, a remote open mailbox button 620*b*, and a remote reset button 620*c*. The buttons 620 are operatively connected to the remote control microprocessor. The remote lock mailbox button 620*a* allows a user to lock the mailbox independently of the control box 210 (e.g., the user may wish to relock the mailbox housing after opening the mailbox housing, for example is he/she changes his/her mind about getting the mail). The remote open mailbox button 620*a* allows a user to open the mailbox housing 110 independently of the control box 210 (e.g., without having to go into the home where the control box 210 is). The remote reset button 620*c* allows a user to deactivate the alarm system independently of the control box 210.

In some embodiments, the remote control microprocessor is configured to receive a first remote lock button input signal from the remote lock mailbox button 620*a* when the remote lock mailbox button 620*a* is pressed. When the remote control microprocessor receives the first remote lock button input signal the remote control microprocessor sends a first remote transmitter output command to the remote control transmitter to cause the remote control transmitter to send a first remote transmitter signal to the first receiver in the mailbox housing 110. When the first receiver receives the first remote transmitter signal, the first receiver sends a first remote lock input signal to the mailbox microprocessor. Upon receipt of the first remote lock input signal, the mailbox microprocessor generates a first lock output command to the lock system so as to lock the lock system (see FIG. 21A).

In some embodiments, the remote control microprocessor is configured to receive a first remote open button input signal from the remote open mailbox button 620*b* when the remote open mailbox button 620*b* is pressed. When the remote control microprocessor receives the first remote open button input signal the remote control microprocessor sends a second remote transmitter output command to the remote control transmitter to cause the remote control transmitter to send a second remote transmitter signal to the first receiver in the mailbox housing 110. When the first receiver receives the second remote transmitter signal, the first receiver sends a second unlock input signal to the mailbox microprocessor. Upon receipt of the second unlock input signal, the mailbox microprocessor generates a first unlock output command to the lock system so as to unlock the lock system (see FIG. 21B).

In some embodiments, the remote control microprocessor is configured to receive a first remote rest button input signal from the remote reset button 620*c* when the remote reset button 620*c* is pressed. When the remote control microprocessor receives the first remote reset button input signal the remote control microprocessor sends a third remote transmitter output command to the remote control transmitter to cause the remote control transmitter to send a third remote transmitter signal to the second receiver in the control box 210. When the second receiver receives the third remote transmitter signal, the second receiver sends a fifth receiver input signal to the control box microprocessor. Upon receipt of the fifth receiver input signal, the control box microprocessor generates a fifth reset output command to the alarm system so as to reset the alarm system (see FIG. 21 D).

The remote control 610 comprises a power source, for example a battery (e.g., standard battery, rechargeable battery).

In some embodiments, the control box 210 further comprises a control box lock button 690 (see FIG. 20, FIG. 22) for allowing a user to lock the mailbox housing 110 from the control box 210. The control box lock button 690 is operatively connected to the control box microprocessor. The control box microprocessor is configured to receive a first control box lock input signal from the control box lock button 690 when the control box lock button 690 is pressed. Upon receipt of the first control box lock input signal, the control box microprocessor generates a fifth transmitter output command to the second transmitter to cause the second transmitter to send a fifth transmitter signal to the first receiver in the mailbox housing 110. When the first receiver receives the fifth transmitter signal, the first receiver send a first control box lock input signal to the mailbox microprocessor whereupon the mailbox microprocessor generates the first lock output command to the lock system to lock the lock system (see FIG. 21C).

As stated previously, the mailbox housing 110 may need to be unlocked in an emergency (see mechanism above). In some embodiments, when the mailbox housing 110 is unlocked in this manner (e.g., if the tool key is inserted), the alarm system is activated. The reset button can be pressed to stop the alarm system (or the remote reset button can be pressed).

As used herein, an embodiment wherein the power source is a battery includes an embodiment wherein the power source is a rechargeable battery.

Figure 20:
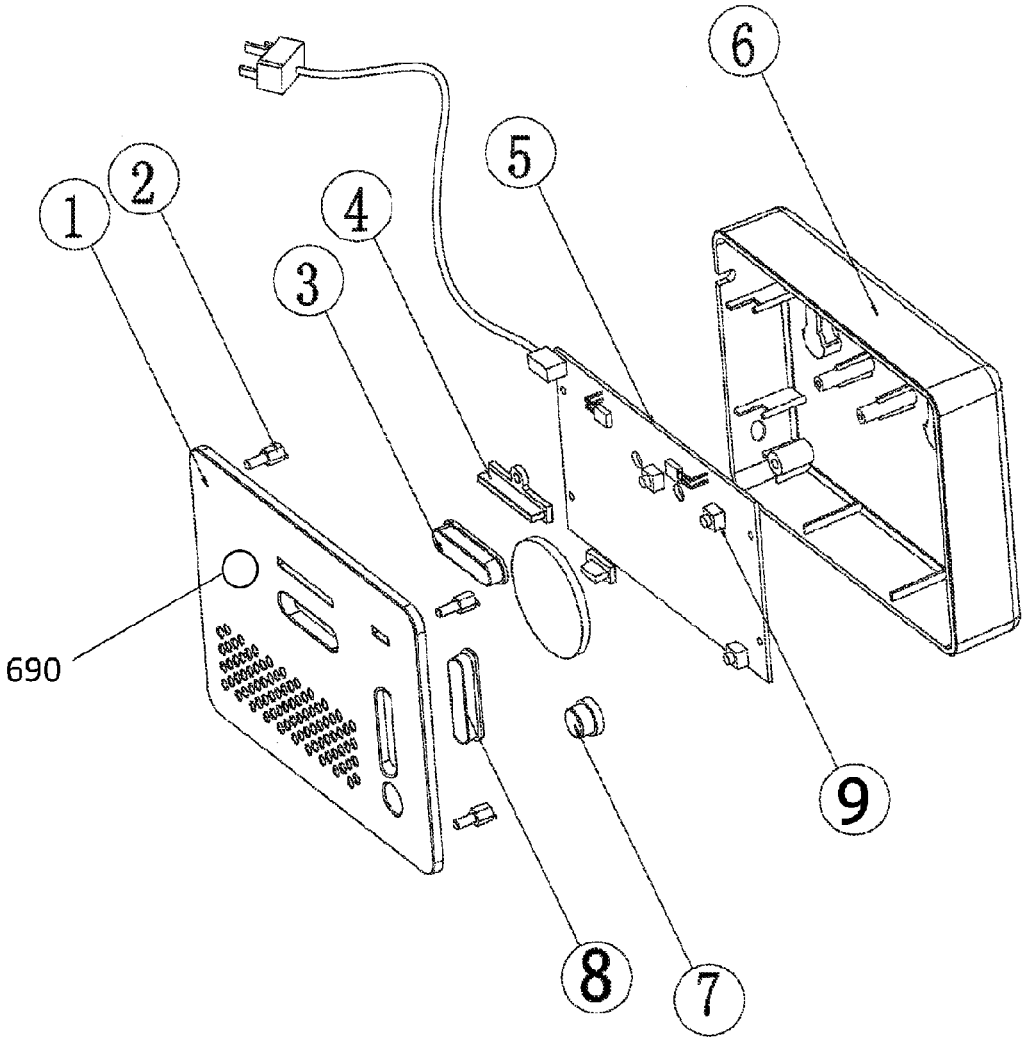
FIG. 20 is an exploded view of an alternative control box of the system of the present invention (with a lock button 690, with a secondary light component 9).
Figure 21A:
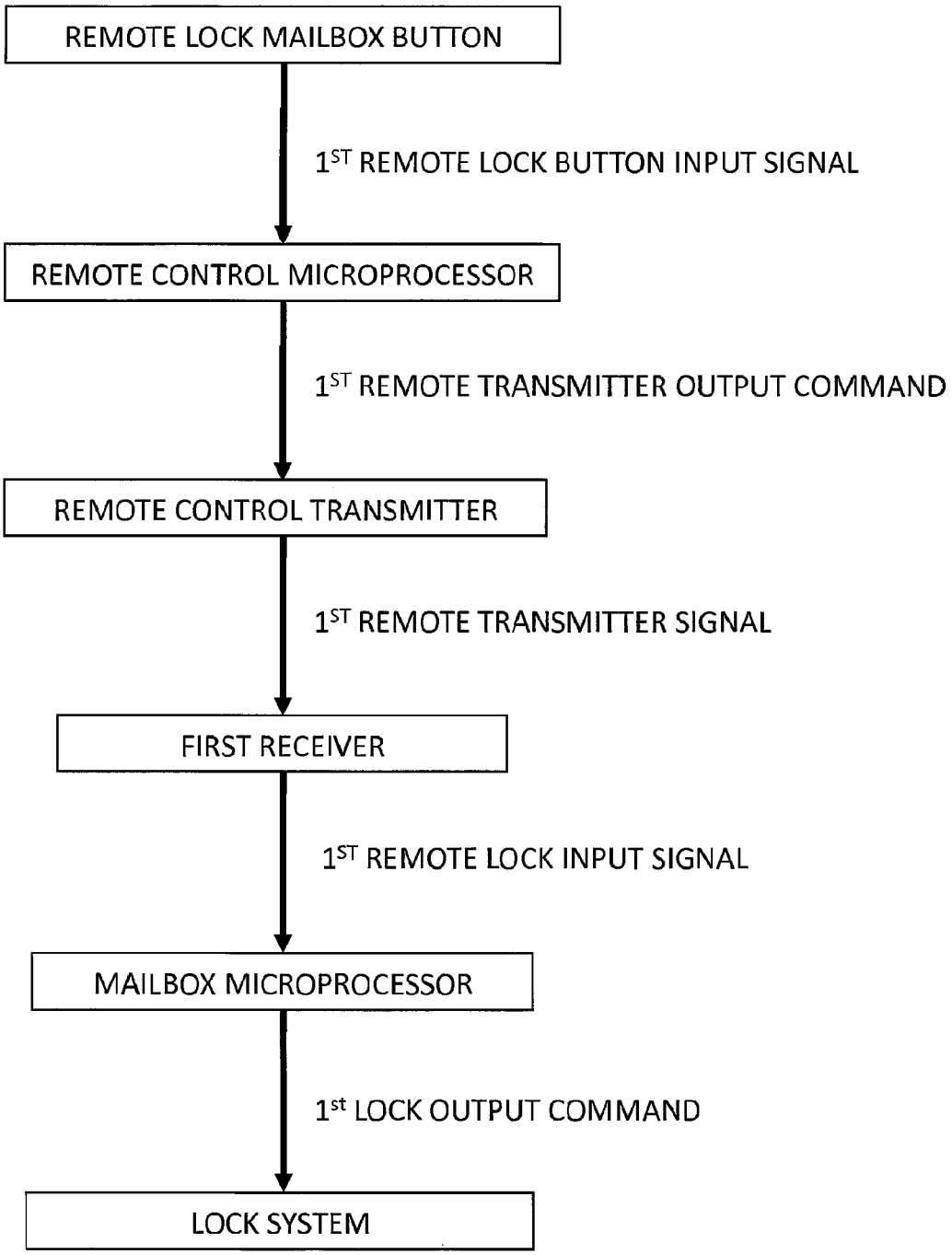
FIG. 21A-D are schematic representations of input signals and output commands of the control box, remote control and mailbox housing in the system of the present invention.
Figure 21B:
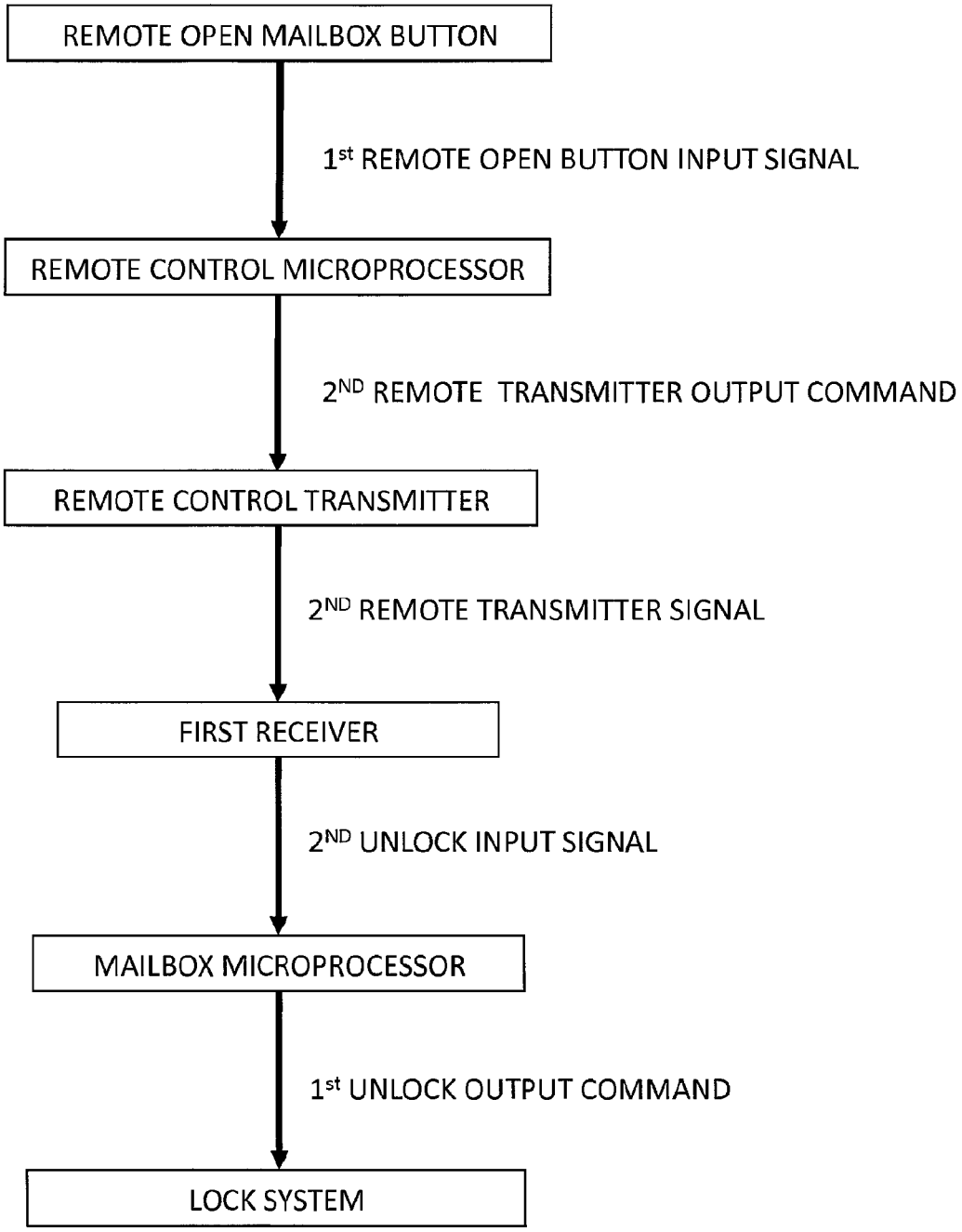
Figure 21C:
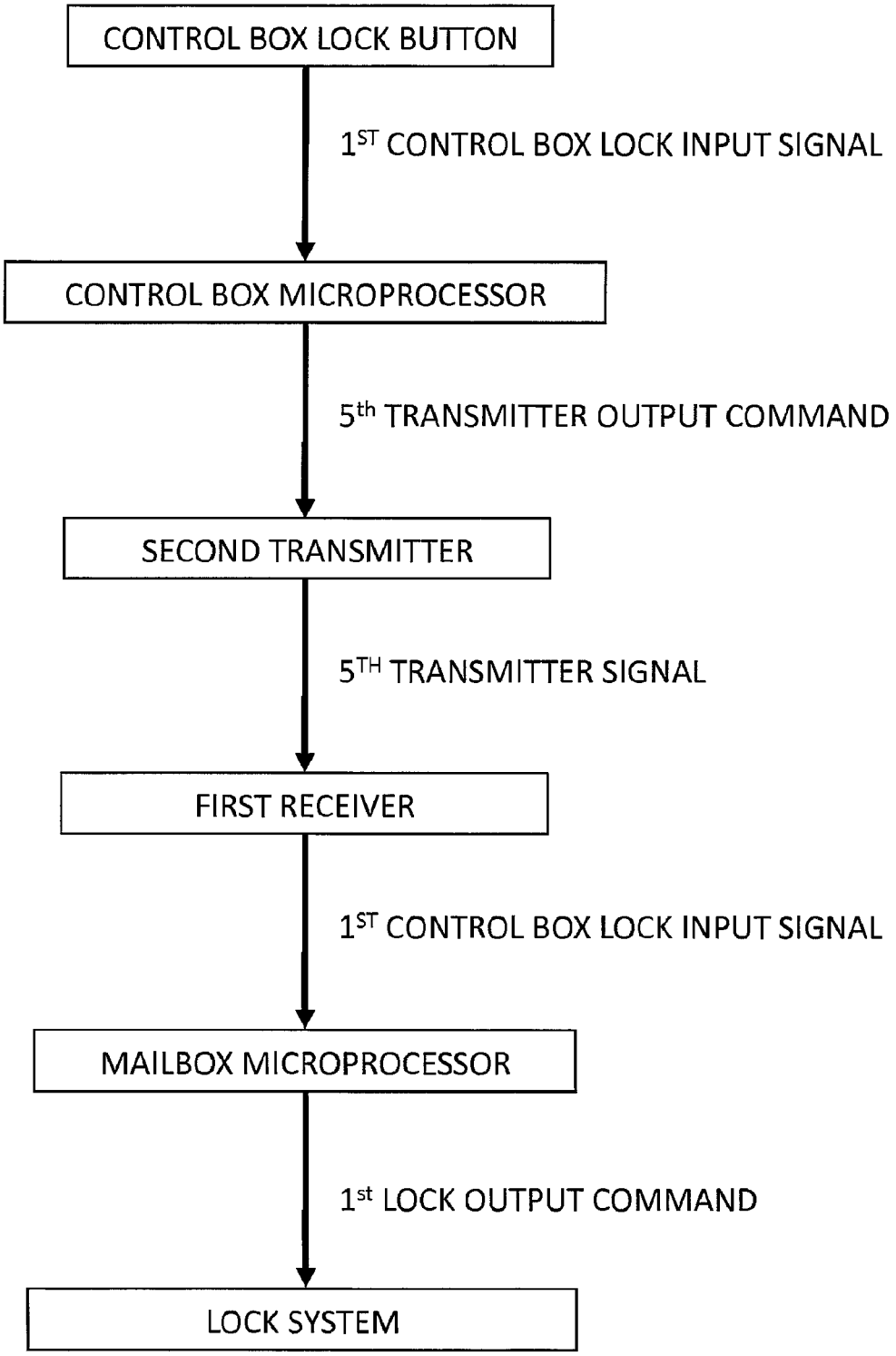
Figure 21D:
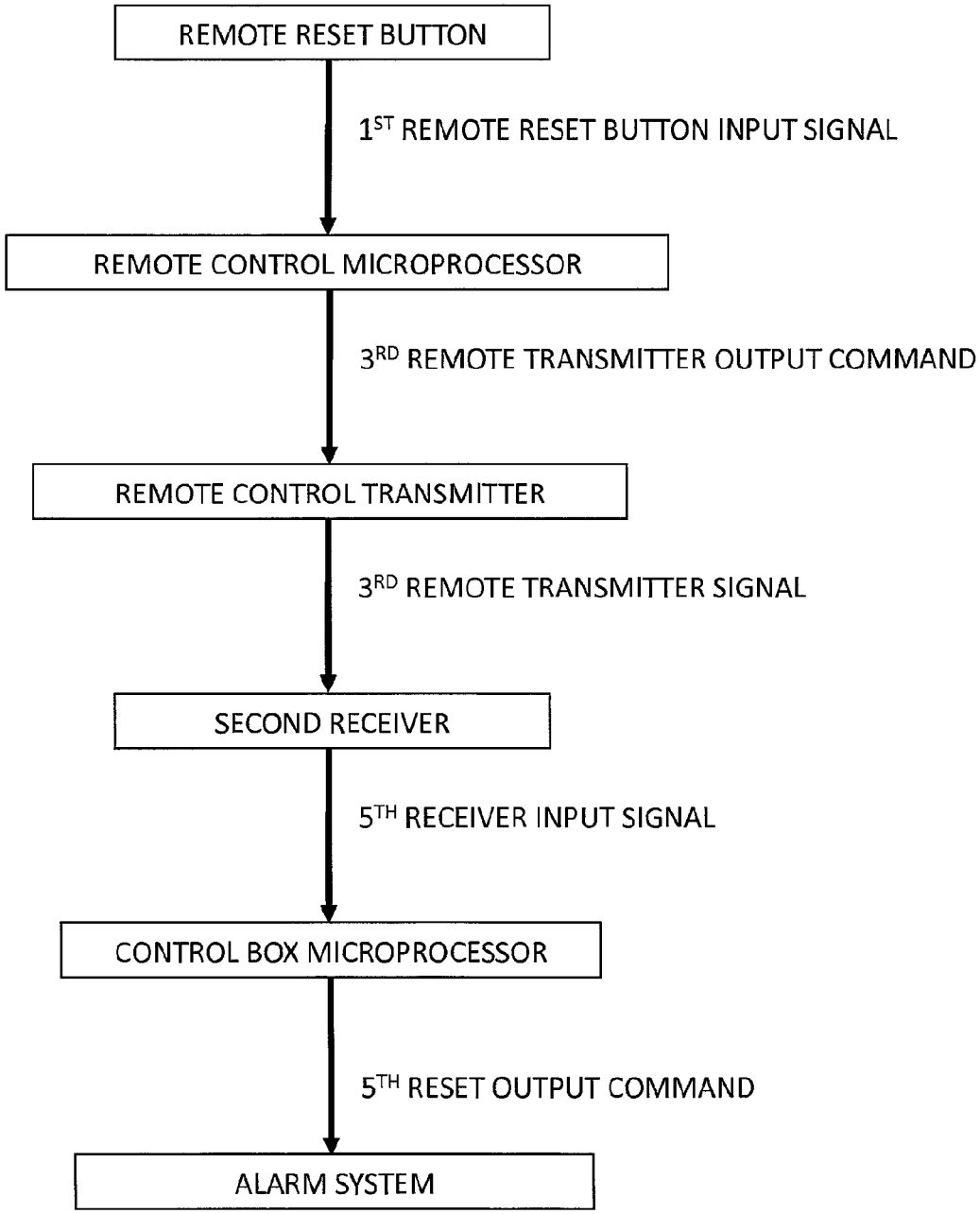
Figure 22:
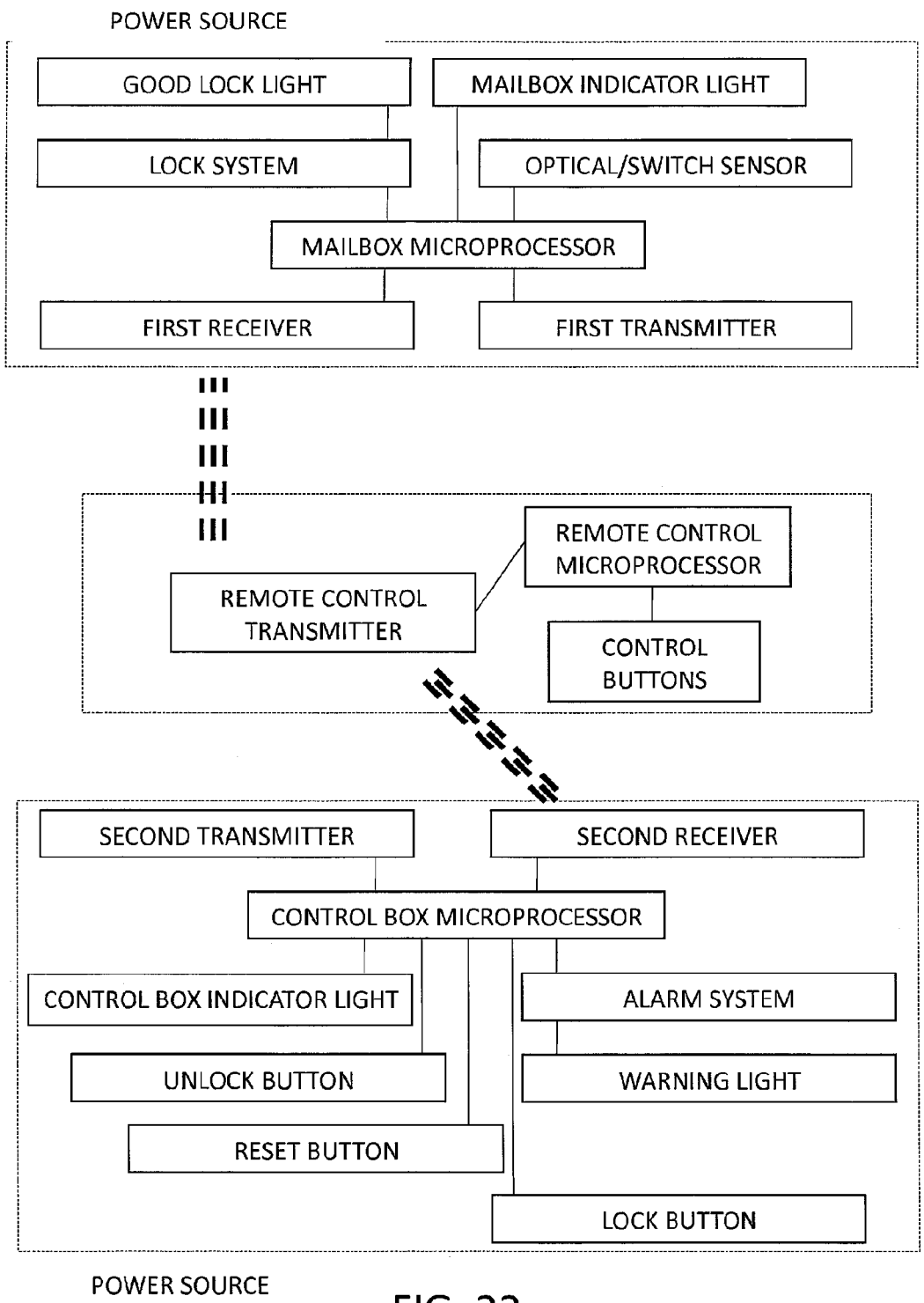
FIG. 22 is a schematic representation of electrical components of the system of the present invention for embodiments including a remote control.

Referring now to FIG. 20, shows an exploded view of a control box 210 comprising a front surface 1, a hex pin 2, a reset button 3, a LED lens 4 (of the reset button 3), a printed circuit board (PCB) monitor 5, a back surface 6 (of the control box), an unlock button 7, and volume buttons 8. In some embodiments, the control box 210 further comprises a secondary light component (LED) 9. The secondary light component 9 in FIG. 20 may be operatively connected to the control box microprocessor. The secondary light component 9 in FIG. 20 may be illuminated (e.g., a red color) when the control box 210 is plugged in. In some embodiments, the secondary light component 9 in FIG. 20 flashes or blinks (e.g., a red color) when the alarm is activated.

Figure 23:
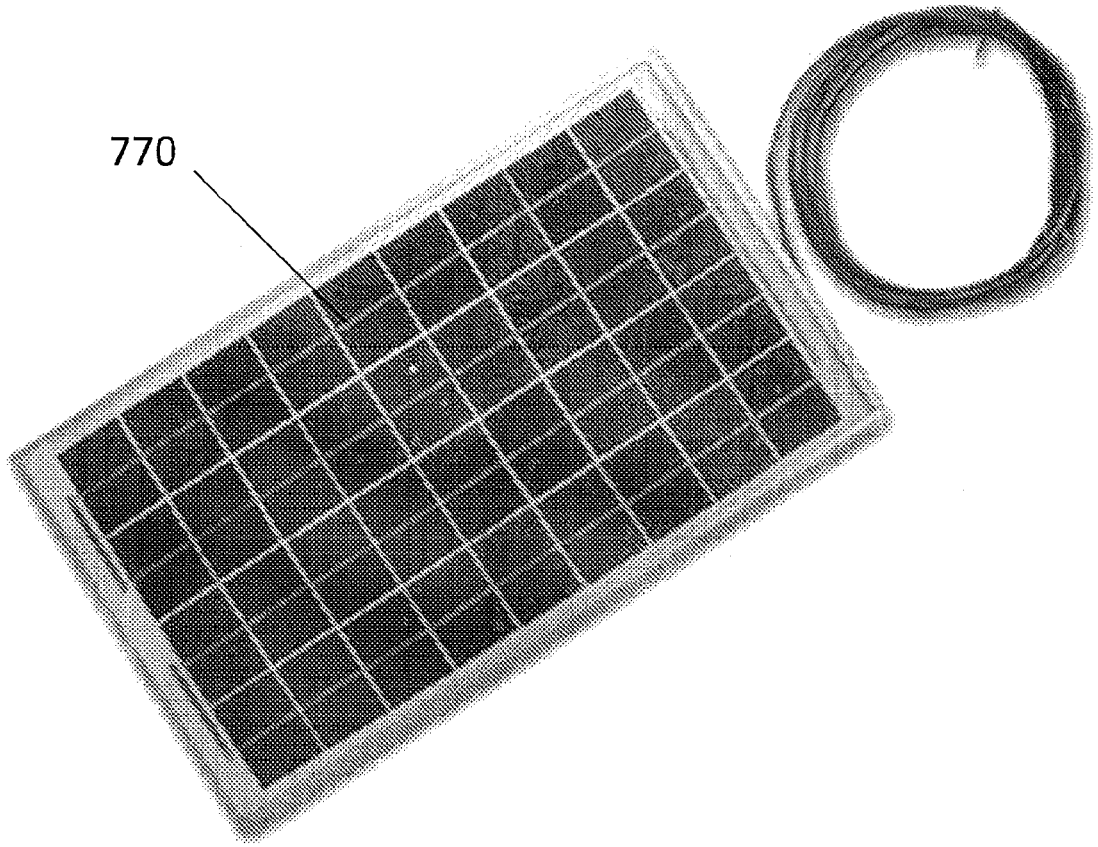
FIG. 23 is a perspective view of a solar panel.

Referring now to FIG. 23, in some embodiments, the system 100 of the present invention utilizes solar power. For example, in some embodiments, one or more solar panels 770 are operatively connected to one or more components of the system 110, for example the mailbox microprocessor and/or the optical switch/sensor and/or the mailbox indicator light and/or the lock system and/or the good lock light and/or the first receiver and/or the second receiver, etc. The solar panels 770 can provide power to the components of the system 100. Solar panels are well known to one of ordinary skill in the art. The solar panels 770 may be used for providing power directly to the components, or the solar panels 770 may be operatively connected to a rechargeable battery and provide power for the battery. The use of solar panels is not limited to the aforementioned examples.

In some embodiments, a single light (light 860, good lock light) is disposed on the mailbox housing, wherein the light can be illuminated in two or more colors (e.g., red, green). In some embodiments, when the lock system is unlocked, the light 860 (good lock light) turns red, and when the lock system is locked the light 860 (good lock light) is green. In some embodiments, when the mailbox housing is plugged in the light 860 is green. The lights of the system 100 of the present invention are not limited to this configuration, color, etc.

The following are additional disclosures of forgoing embodiments of the present invention:

Statement 1. An electronic mailbox system (100) comprising:

(a) a mailbox housing (110) comprising: (i) an inner cavity for holding a piece of mail (530); (ii) a lid (120) moveable between an open position and a closed position respectively allowing and preventing access to the inner cavity; (iii) an electrically-operable lock system (26; 140) operatively connected to the lid, the lock system can move between a locked position which secures the lid in the closed position and an unlocked position which permits the lid to be moved to the open position; (iv) a slot (130) disposed in the mailbox housing for accommodating the piece of mail; (v) a mail sensor (510) for detecting the piece of mail being inserted into the slot; (vi) a first transmitter (410) and a first receiver; and (vii) a mailbox microprocessor operatively connected to each of the mail sensor, the lock system, the first transmitter, and the first receiver; and (b) a control box (210) comprising: (i) a second transmitter and a second receiver, wherein the second receiver is configured to receive signals from the first transmitter and the first receiver is configured to receive signals from the second transmitter; (ii) a control box indicator light (925); (iii) an unlock button (940; 7; 450); (iv) a reset button (930; 13); and (v) a control box microprocessor operatively connected to each the second transmitter, the second receiver, the control box indicator light, the unlock button, and the reset button;

wherein:

the mailbox microprocessor is configured to receive a first sensor input signal from the mail sensor when the mail sensor detects the piece of mail being inserted into the slot whereupon the mailbox microprocessor generates a first transmitter output command to the first transmitter to cause the first transmitter to send a first transmitter signal to the second receiver in the control box; wherein the second receiver is configured to send a second receiver input signal to the control box microprocessor when the second receiver receives the first transmitter signal from the first transmitter, whereupon the control box microprocessor generates a second light output command to the control box indicator light to cause the control box indicator light to become activated;

the control box microprocessor is configured to receive a first unlock input signal from the unlock button when the unlock button is pressed whereupon the control box microprocessor generates a second transmitter output command to the second transmitter to cause the second transmitter to send a second transmitter signal to the first receiver in the mailbox housing; wherein the first receiver is configured to send a second unlock input signal to the mailbox microprocessor when the first receiver receives the second transmitter signal from the second transmitter, whereupon the mailbox microprocessor generates an unlock output command to the lock system to cause the lock system to move to the unlocked position; and the control box microprocessor is configured to receive a first reset input signal from the reset button when the reset button is pressed whereupon the control box microprocessor generates a first reset output command to the control box indicator light to cause the control box indicator light to become deactivated.

Statement 2. A system as outlined in statement 1, wherein the mailbox housing further comprises a mailbox indicator light (60; 430) operatively connected to the mailbox microprocessor; and wherein when the mailbox microprocessor receives the first sensor input signal from the mail sensor the mailbox microprocessor generates a first light output command to the mailbox indicator light to activate the mailbox indicator light.

Statement 3. A system as outlined in statement 2, wherein when the control box microprocessor receives the first reset input signal from the reset button the control box microprocessor generates a second reset output command to the second transmitter to cause the second transmitter to send a third transmitter signal to the first receiver in the mailbox housing; and wherein the first receiver is configured to send a second light input signal to the mailbox microprocessor when the first receiver receives the third transmitter signal from the second transmitter, whereupon the mailbox microprocessor generates a second light output command to the mailbox indicator light to deactivate the mailbox indicator light.

Statement 4. A system as outlined in any preceding statement, wherein the control box further comprises an alarm system (910; 420) operatively connected to the control box microprocessor.

Statement 5. A system as outlined in statement 4, wherein when the control box microprocessor receives the second receiver input signal the control box microprocessor generates a first alarm output command to the alarm system to activate the alarm system.

Statement 6. A system as outlined in statement 4 or 5, wherein when the control box microprocessor receives the first reset input signal from the reset button the control box microprocessor generates a third reset output command to the alarm system to deactivate the alarm.

Statement 7. A system as outlined in any one of statements 4 to 6, wherein:

the mailbox housing also includes a tamper sensor for detecting tampering of the mailbox housing and to which the mailbox microprocessor is operatively connected;

the mailbox microprocessor is configured to receive a second sensor input signal from the tamper sensor when the tamper sensor detects tampering, wherein upon receipt of the second sensor input signal the mailbox microprocessor generates a fourth transmitter output command to the first transmitter to cause the first transmitter to send a fourth transmitter signal to the second receiver, wherein upon receipt of the fourth transmitter signal, the second receiver sends a fourth receiver input signal to the control box microprocessor whereupon the control box microprocessor generates a second alarm output command to the alarm system to activate the alarm system; and the control box microprocessor is configured so that, upon receipt by the control box microprocessor of the first reset input signal, the control box microprocessor generates a third reset output command to the alarm system to deactivate the alarm.

Statement 8. A system as claimed in statements 5 and 7, wherein the alarm system is configured to emit a first sound when the alarm system receives the first alarm output command and the alarm system is configured to emit a second sound when the alarm system receives the second alarm output command.

Statement 9. A system as outlined in any preceding statement, further comprising a newspaper holder (14; 880; 180) disposed on the mailbox housing.

Statement 10. A system as outlined in any preceding statement, wherein the mailbox housing further comprises an awning (7; 139) positioned over the slot to help prevent moisture from entering into the slot Statement 11. A system as outlined in any preceding statement, wherein the mailbox housing further comprises an inner door (540) attached to an inside surface of a front surface of the mailbox housing such that it covers the slot, the inner door is moveable between an open position and a closed position respectively allowing and preventing access to the inner cavity of the mailbox housing, the inner door is biased in the closed position caused by a spring (550).

Statement 12. A system as outlined in any preceding statement, wherein the lock system comprises a good lock light for indicating the lock system is in the locked position.

Statement 13. A system as claimed in any preceding claim, wherein the lock system comprises an emergency unlocking mechanism (735,710,705). [0117] 14. A system as claimed in any preceding claim, wherein the lock system comprises an auto-lock mechanism, the auto-lock mechanism function to causing the lock system to become locked after a certain length of time after the lock system has been unlocked. [0118] 15. A system as claimed in claim 14, wherein if the lock system is not relocked after the certain length of time the alarm system is activated.

Figure 24:
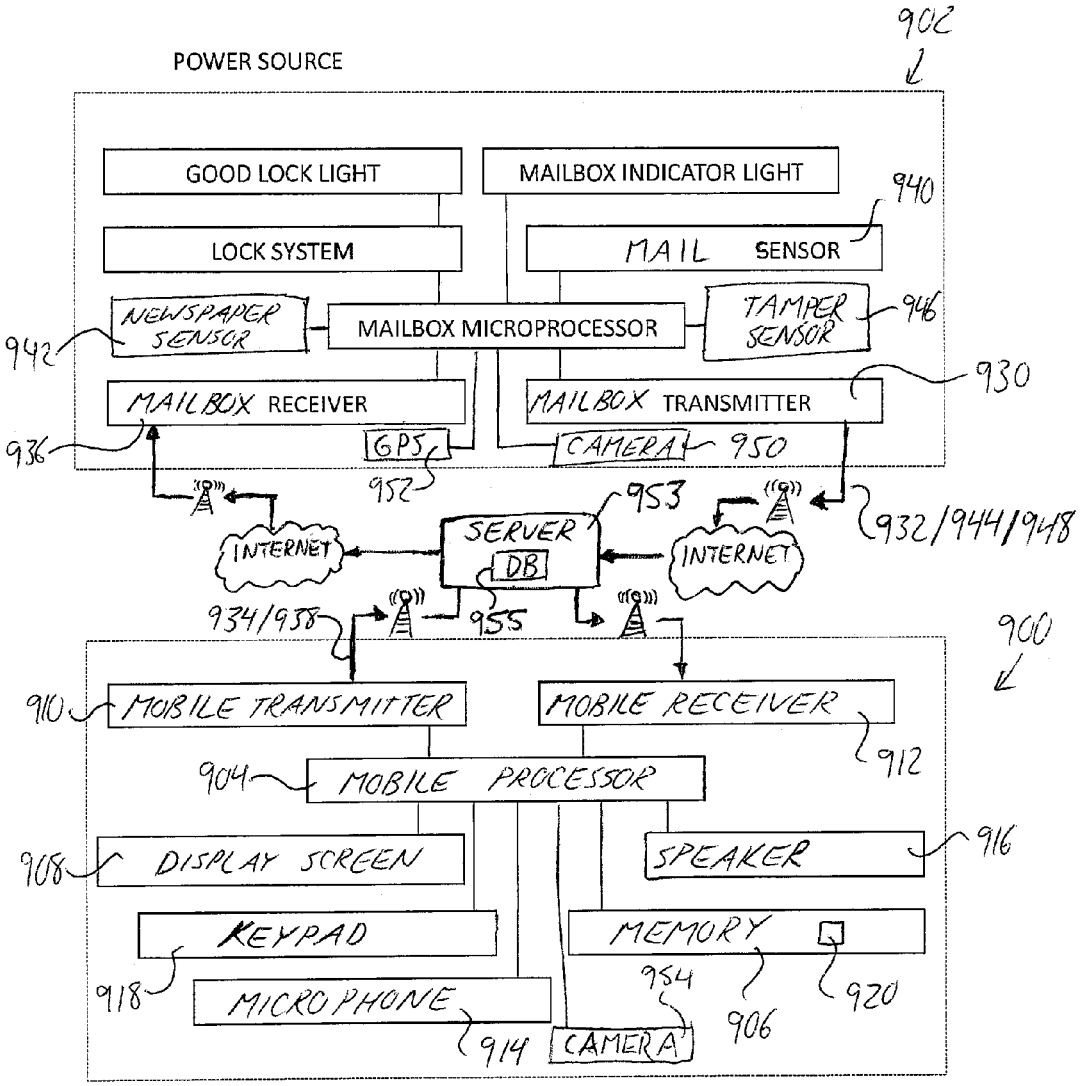
FIG. 24 is a schematic illustration of another embodiment of the mailbox system of the present invention, in which a mobile device such as a smart phone or tablet device is operable to control the mailbox and receive alerts therefrom.

FIG. 24 schematically illustrates another embodiment of the present invention in which a handheld, mobile, multipurpose consumer electronics device 900, such as cellular phone or tablet computer, is used to control the mailbox 902. The mailbox may also been controllable by one or both of the control box and remote of the preceding embodiments in the manner described above. That is, the mobile device may be an addition to the system, or an alternative to the control box and/or remote.

The illustrated mobile device includes a number of components typical of most smart phones or tablet computers, including a processor 904, computer readable memory 906 for reading and writing of data from and to the computer readable memory by the processor, a visual display screen 908, a transmitter 910, a receiver 912, an audio input device or microphone 914, an audio output device or speaker 916, and a physical input device 918 for input from a user, for example in the form of one or more of a tactile keypad/keyboard, touchscreen, and feature/function buttons distinct from the tactile keypad/keyboard or touchscreen. Smart phones use mobile operating systems capable of running software applications by third party developers, whereby a user can load a software program 920 of the present invention into the memory 906 of their existing phone to enable use of the phone to control a mailbox system of the present invention.

When insertion of a piece of mail into the inner cavity of the mailbox 900 is detected as described in preceding embodiments, the mailbox transmitter 930 emits mail received signal 932 for wireless receipt of this signal by the receiver 912 of the mobile device 900 via a cellular telecommunications network. With the software application 920 running on the mobile device, receipt of the mail received signal 932 at the mobile device is recognized, and in response, one or more 'mail received' alerts is triggered to inform the mobile device user of the arrival of mail at the mailbox. The alert may be a visual on-screen alert displayed on the display screen 908 of the mobile device, an audible alert in the form of a sound emitted from the speaker 916 of the mobile device, or a combination thereof. Where the phone is equipped with a vibrational device, (as is often used as a physical notification that an event has occurred while the speaker-emitted sound of the device is muted), a vibration alert of the mail arrival event may be triggered by the mail received signal.

In addition to using the mobile device for mail delivery notices to the user when at locations remote from the residence or business where the mailbox is installed, the mobile device is also operable to control the lock system of the mailbox, whereby a user of the system can unlock the mail box without having to carry a dedicated remote control device for the mailbox. This can be useful for the mail addressee to allow opening of the mailbox at an outdoor, residential installation site thereof upon returning home from a remote location without having to first enter the home to access the control box, or having to remember to take a dedicated remote control with them when leaving the home. This also has other purposes, for example allowing the home owner to unlock the mailbox from remote locations, for example to enable a neighbor to collect the mail while the homeowner is away on a vacation, a business trip or other travel. The neighbor can simply text message, call or email the homeowner to inform them of an intention to check the homeowners mailbox, in response to which the homeowner can confirm their availability to unlock the mailbox from their current location, so long as cellular service is available. The lack of a prompt reply may inform the neighbor that the homeowner is not available at that moment to unlock the mailbox, whereby the neighbor can attempt a similar mail retrieval process at a later time.

In order to unlock the mailbox, the mobile device user inputs an unlock command to the running software program using a suitable input device of the mobile device, for example touching an 'unlock' button icon displayed on a touchscreen mobile device with a finger or stylus, or navigating to and clicking or selecting an on-screen option using navigation buttons on the keypad/keyboard, a separate feature or function button linked to the on-screen option, or a trackball or other input device of the mobile device. This causes the transmitter 910 of the mobile device to send an outgoing unlock signal 934 over the cellular network to the mailbox, where the mailbox receiver 936 receives this unlock signal 934, upon which the processor sends an internal unlock signal to the lock system in order to move the lock system to the unlocked position. Accordingly, the mailbox is unlocked, and the lid can be opened for retrieval of the piece or pieces of mail from the mailbox interior.

As an alternative to use of a touchscreen, keypad/keyboard or feature/function buttons to provide the unlock command, the software application may use a voice recognition routine to recognize verbal commands received through the microphone 914 of the mobile device to trigger the unlock signal.

As outlined above, the mailbox may uses a spring loaded lid that will automatically close, and may have an auto-lock feature to accordingly return the lock to the locked position after expiry of a predetermined amount of time, which in some embodiments may be anywhere between 1 and 10 minutes, for example 2 minutes in one particular embodiment. This re-lock delay time may be measured from the time the lid is unlocked, for example by triggering of the timer in response to the unlock signal, or may be measured from a time when the lid is re-closed, for example as may be monitored using a suitable position sensor detecting changes of the lid between the open and closed positions. In embodiments with this timed automatic re-lock functionality at the mailbox, the software application on the phone may be configured to have a timer display routine that is triggered in response to the input of the lock command at the mobile device and which acts to display a count-down sequence on the display screen 908 that counts down the amount of time before the mailbox will automatically re-lock itself.

The mobile device may also be operable to lock the mailbox, whereby the auto-lock functionality of the mailbox need not necessarily be relied upon, and the user can choose to promptly re-lock the mailbox after closing of the lid prior to expiry of the predetermined re-lock delay time. The user of the mobile device inputs a lock command to the running software program using a suitable input device, which may be any of the types described above for the unlock function (e.g. touchscreen, keypad/keyboard, function/feature buttons, voice command, etc.). This causes the transmitter 910 of the mobile device to send an outgoing lock signal 938 over the cellular network to the mailbox, where the mailbox receiver 936 receives this unlock signal 938, upon which the processor sends an internal lock signal to the lock system in order to move the lock system to the locked position. Accordingly, the mailbox is securely re-locked under the control of the user.

The mobile device and mailbox may also be configured to provide confirmation of the lock/unlock command signals by the mailbox in order to provide the user with confirmation of the resulting status of the mailbox lock. That is, having successfully been locked, the mailbox sends a lock confirmation signal to the mobile device, in response to which on on-screen indicator reflective of the confirmed locked status of the mailbox is displayed on the display screen of the mobile device. Likewise, an unlocked on-screen indicator is shown on the screen of the mobile device upon received of an unlocked confirmation signal from the mailbox after any unlocking of the mailbox occurs. The mobile device user can therefore be confident that the requested mailbox action they inputted on the mobile device has been received by the mailbox, and can be informed when the mailbox has been unlocked by some other means.

In addition to the aforementioned mail received alert, the mobile device may provide other alerts concerning the status of the mailbox. For example, in addition to the mail sensor 940 for detecting insertion of mail into the mailbox through the slot, the mailbox may feature a newspaper sensor 942 mounted to the newspaper holder of the mailbox in order to detect placement of a newspaper thereon. An internal newspaper received signal is generated in response to same and sent the processor, which then causes the mailbox transmitter to transmit an external newspaper received signal 944 to the mobile device 900, which may be at a location remote from the mailbox site at this time, over the cellular network. With the software application 920 running on the mobile device 900, receipt of the newspaper received signal 944 at the mobile device is recognized, and in response, one or more 'newspaper received' alerts is triggered to inform the mobile device user of the arrival of mail at the mailbox. Like the mail received alert, the newspaper received alert may be a visual on-screen alert, an audible alert, a vibrational alert, or any combination thereof.

The tamper sensor 946 may also be arranged to cause transmission of a signal to the mobile device to trigger a respective alert to the mobile device user. An internal tamper signal is generated in response to detection of mailbox tampering by the sensor, which then causes the mailbox transmitter to transmit an external tamper signal 948 to the mobile device 900. With the software application 920 running on the mobile device 900, receipt of the tamper signal 948 at the mobile device is recognized, and in response, one or more tamper alerts is triggered to inform the mobile device user of the arrival of mail at the mailbox. The alert may be any of the aforementioned types outlined above for the other mail and newspaper alerts. The mail, newspaper and tamper alerts may all be different and distinct from one another to allow the user to recognize the type of event that has occurred at the mailbox based on the type of alert. For example, audible alerts for these three events may each have a respective sound distinct from the others.

The mailbox 902 may include a camera 950 for capturing still images or video images at the location of the mailbox, which may be activated for capturing images at that location in response to receipt of the tamper signal from the tamper sensor 946. The image data of the captured images is transmitted by the mailbox transmitter 930 for receipt of the image data by the receiver 912 of the mobile device 900. The image data is used by the software application to display the captured images on the display screen 908 of the mobile device. The image data may be transmitted automatically, and for example stored by the mobile device for viewing up on the user's selection to do so, or may be transmitted only in response to a request initiated by the user at the mobile device after having realized and acknowledged a tamper alert issued by the mobile device.

The mailbox 902 may include a GPS (Global Positioning System) device 952 operable to determine the location of the mailbox 902 at a given point in time, which is useful if the mailbox as a whole is stolen from its installed position. In response to detecting a change in the mailbox's location, the GPS device causes a locating signal containing data on the current location of the mailbox to be transmitted by the mailbox transmitter 930 on a continuous, or ongoing periodic basis. The software application on the mobile device includes a tracking function operable to receive the location signal, and show a map on the display screen of the device together with a positional marker displayed on said map. The position of the marker on the maps reflects the latest received location data from the mailbox, and is updated as this information changes, whereby the mobile device tracks the changing location of the mailbox and shows the user the current location in substantially real time. Accordingly, the mobile device user, or authorities (e.g. police, postal authorities, etc.) may be able to track down and recover the stolen mailbox.

For embodiments with the GPS tracking functionality, the transmitter 930 and receiver 936 in the mailbox may be in the form of a cellular transceiver configured for wireless data transfer over the internet via a cellular communication network. In other embodiments, the mailbox may use a Wi-Fi transceiver connected to a wireless local area network (WLAN), for example connected to a computer inside the residence or business of the mailbox owner and connected to the internet. The mobile device and the mailbox send their respective signals to a server 953, from where the signals originating from the mailbox are forwarded to the mobile device via a cellular communication network, and the signals originating from the mobile device are forwarded to the mailbox to via a cellular communication network, or via the internet and WLAN.

When the mobile device user runs the software application for the first time, a setup routine is run, in which the user interface requests that the user enters a serial number of the mailbox, or other unique alphanumeric code associated the user's particular mailbox, or requests input of a picture image of a barcode or QR-code that is present on the product packaging of their purchased mailbox. Using known barcode or QR-code scanning software, the picture image, for example as captured by the user using an on-board camera 954 of the mobile device, is scanned in order to extrapolate a unique code or identifier associated with that particular mailbox. This unique code, whether manually entered by the user or retrieved by the barcode or QR-code scan, is used in an authentication process for ensuring that only the mailbox owner, or other person(s) authorized thereby, can control operation of the mailbox from their mobile device.

The software application connects the mobile device to the server 953, which compares the unique code against a list of codes that are stored in a database 955 and have been assigned to mailboxes manufactured according to the present invention. By finding a listed code matching the code received from the user's mobile device, the server has matched up the user's mobile device to his or her mailbox. In the database, the server adds a unique identifier associated with the mobile device in the database entry for that particular mailbox. Accordingly, each time that mobile device connects to the server and provides its identifier, the server can look up the identifier and find the matching mailbox in order to route the signal from the mobile device to the correct mailbox. Likewise, each time the mailbox connects to the server and identifies itself to same, the server can use the previously matched mobile device identifier to route the signal from the mailbox to the correct user's mobile device. Other embodiments may employ other known methods of establishing data communication between two mobile devices on a cellular telecommunications network.

The server and database may be configured to allow storage of multiple mobile device identifiers for each mailbox, whereby multiple users having their own respective mobile devices can control the mailbox and receive alerts therefrom, for example giving access to a shared mailbox by each one of multiple family members, room-mates or work-mates. The number of possible authorized users for each mailbox may be limited to a predetermined maximum, for example up to 10-users per mailbox.

While the above embodiment employs data transmission over the internet to transmit signals between the mailbox and the mobile device, other embodiments may employ other modes of connection. For example, in embodiments with a cellular transceiver in the mailbox, the transceiver may be assigned a telephone number to which voice calls or text messages from the mobile device may be placed. For example, to initially setup the mailbox, the user sends a text message to the mailbox that includes a predetermined instruction code followed by the phone number of the mobile device. The mailbox recognizes the instruction code as an instruction to record the phone number following the instruction code as an authorized phone number from which subsequent text messages or phone calls should be accepted. Text messages from that mobile device can then similarly be used to control the mailbox, for example sending a text-message reading "unlock" to the mailbox phone number to unlock the mailbox, or a "lock" text message to lock the mailbox. The mailbox may then use the authorized phone number to send mail received, newspaper received and tamper signals to in text message format. Other embodiments may use audio calls instead of text messages, for example using touch-tone signal recognition or voice recognition to enter at the mailbox to decipher instruction codes and lock/unlock signals, and sending automated voice calls to the mobile device to playback human-recorded or computer-generated audio messages with verbal indications of delivery or tampering events at the mailbox. Other embodiments may use emails to transmit signals between the mailbox and the mobile device.

In the embodiment of FIG. 24, some notable features are that:

1) the electronic security mailbox system can be opened and closed using smart phone and tablet communication technology.
2) The electronic security mailbox system will alert the user with an intruder alert to his smart phone or tablet if an intruder forces mailbox open or attempts to break open the electronic mailbox system. The tamper sensor will trigger an alarm on the user phone and the indoor monitor.
3) The electronic security mailbox system will show live footage of a timer, so that if user does not want to lock the mailbox right away he can wait for mailbox to auto re-lock after expiry of predetermined delay time, for example within 2 minutes.
4) The electronic security mailbox system can send up to 10 signals per household to notify user of mail theft, and 10 people can have access to open the mailbox once connected to the electronic mailbox system.
5) The electronic security mailbox system could also alert users that there is mail in the mailbox. When inserted by the mailman, that user will receive a text, email or ring to his smart phone or tablet, or the user can check the status of his mail using his smart phone or tablet.
6) The electronic security mailbox system and the smart phone or tablet can communicate with each other, for example showing live or recorded still images or video footage of the mail theft, as the pictures or video of the theft can be sent to the smart phone and tablet.
7) The smart phone or tablet can connect by simply logging in to a secure network for the electronic security mailbox system and downloading the wireless mailbox app, which could be free to download or may require payment of a fee for service. After downloading the wireless mailbox app, the user may be required to setup a name and password that will need to be entered before entering an unlock command so that the user's mobile device cannot be used by others for unauthorized unlocking of the mailbox. Multiple users in the same household can control the Electronic mailbox system by the same password and user name, thereby giving access to the mailbox by all users of the mailbox within the same household. Once connected to the receiver for the electronic mailbox system through the electronic mailbox network, the user will be able to enjoy state of the art security for their electronic security mailbox.

8) The Electronic security mailbox system could also alert user that he has a newspaper in the newspaper holder so that he does not need to waste trips to the empty mailbox for his newspaper, and can instead find out if he has mail or news paper from his smart phone or tablet.

9) The electronic mailbox system may come with a bar code number, which for example can be used to register the smart phone and tablet with the mailbox so that the devices can work and communicate together.

10) The Electronic mailbox system mailbox remote control may also be included, an may also be equipped to alert user that his mail is being stolen and alert him of delivered mail by receiving tamper and mail received signals from the mailbox, similar to the phone or tablet, but through direct RF communication between the mailbox and the remote. The mailbox may have two different transceivers in order to communicate with the remote and the mobile device through different modes of wireless communication.

11) The download app for the electronic security mailbox system may allow user to input his voice for voice recognition purposes, whereby the user can speak to the smart phone to provide verbal mailbox commands. For example if user wanted to lock the mailbox system, he could simply sign in to his account say "lock the mailbox" or "unlock the mailbox", or something of similar meaning, for which the request will send a signal to lock the mailbox or to unlock the mailbox.

Various modifications of the invention, in addition to those described herein, will be apparent to those skilled in the art from the foregoing description. Such modifications are also intended to fall within the scope of the appended claims.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

The invention claimed is:

1. An electronic mailbox system comprising:

a mailbox comprising: (i) a housing having an inner cavity for holding a piece of mail; (ii) a lid moveable between an open position and a closed position respectively allowing and preventing access to the inner cavity; (iii) an electrically-operable lock system operatively connected to the lid, the lock system being movable between a locked position which secures the lid in the closed position and an unlocked position which permits the lid to be moved to the open position; (iv) a slot disposed in the mailbox housing for accommodating the piece of mail through the slot and into the inner cavity; (v) a mail sensor for detecting the piece of mail inserted into the cavity through the slot; (vi) a first transmitter and a first receiver; and (vii) a first processor operatively connected to each of the mail sensor, the lock system, the first transmitter, and the first receiver;

a handheld mobile device comprising a smart phone or tablet computer that is arranged to connect to a wireless telecommunications network and comprises (i) a second transmitter and a second receiver; (ii) at least one output device; (iii) at least one input device; and (iv) a second processor operably connected to the second transmitter, the second receiver, the output device, and the input device;

wherein the first processor at the mailbox is arranged to (i) in response to an internal mail received signal generated by the mail sensor upon receipt of the piece of mail in the inner cavity, transmit an external mail received signal from the first transmitter; and (ii) in response to receipt of an external unlock signal by the first receiver, send an internal unlock signal to the electrically-operable lock to effect movement thereof to the unlocked position;

wherein the second processor is arranged to (i) in response to receipt of an incoming mail received signal at the second receiver via the a wireless telecommunications network, generate a received mail alert via the at least one output device of the handheld mobile device; and (ii) in response to an unlock command received from a user via the input device, transmit an outgoing unlock signal from the second transmitter of the handheld mobile device.

2. The electronic mailbox system of claim 1 wherein the mailbox comprises a newspaper holder situated outside the inner cavity of the mailbox housing and a newspaper sensor connected to the first processor and operable to detect placement of a newspaper on said newspaper holder, the first processor at the mailbox being arranged to have the first transmitter transmit an external newspaper received signal in response to an internal newspaper received signal from the newspaper sensor, and the second processor at the handheld mobile device being arranged to generate a received newspaper alert via the at least on output device of the handheld mobile device in response to an incoming newspaper received signal received by the second transmitter.

3. The electronic mailbox system of claim 2 wherein the alerts are different and distinct from one another.

4. The electronic mailbox system of claim 1 wherein the mailbox comprises a tamper sensor connected to the first processor and operable to detect tampering of the mailbox housing, the first processor at the mailbox being arranged to have the first transmitter transmit an external mailbox tamper signal in response to an internal mailbox tamper signal from the tamper sensor, and the second processor at the handheld mobile device being arranged to generate a mailbox tamper alert via the at least one output device of the handheld mobile device in response to an incoming mailbox tamper signal received by the second transmitter.

5. The electronic mailbox system of claim 4 wherein the mailbox comprises an image capture device arranged to capture images at a location of the mailbox in response to the internal tamper signal in order to record at least one image of a tampering event.

6. The electronic mailbox system of claim 5 wherein the first transmitter is arranged to transmit image data reflective of said recorded image to a remote location.

7. The electronic mailbox system of claim 6 wherein the at least one output device of the handheld mobile device comprises a display screen, and the second receiver is arranged to receive the image data for display of said recorded image on the display screen.

8. The electronic mailbox system of claim 4 wherein the alerts are different and distinct from one another.

9. The electronic mailbox system of claim 1 wherein the at least one output device comprises a display screen, and each alert comprises a visual alert displayed on said display screen.

10. The electronic mailbox system of claim 1 wherein the at least one output device comprises a speaker, and each alert comprises an audible alert sounded from said speaker.

11. The electronic mailbox system of claim 1 comprising a server connected to a network to which the mailbox and the handheld mobile device are also connected, wherein the server is arranged to receive the external mail received signal from the mailbox and, in response thereto, send the incoming mail received signal to the handheld mobile device; and to receive the outgoing unlock signal from the handheld mobile device and, in response thereto, send the external unlock signal to the mailbox.

12. The electronic mailbox system of claim 1 wherein the handheld mobile device comprises computer readable memory having a software application stored thereon for execution by the processor, including an authentication routine arranged to receive an authentication code associated with the mailbox and transmit an outgoing authentication code signal from the handheld mobile device to a remote server having a database containing a collection of authentication codes for multiple mailboxes, the server being arranged to compare said authentication code against the collection of authentication codes, and in response to finding a match for said authentication code, authorize control of the mailbox by the handheld mobile device.

13. The electronic mailbox system of claim 1 wherein the at least one input device of the handheld mobile device comprises a microphone and the handheld mobile device comprises computer readable memory having a software application stored thereon for execution by the processor, including a voice recognition function operable to detect a verbal unlock command received from the microphone and, in response to said verbal unlock command, transmit the outgoing unlock signal from the second transmitter of the handheld mobile device.

14. The electronic mailbox system of claim 1 wherein the at least one output device of the handheld mobile device comprises a display screen, the mailbox comprises an autolock mechanism operable to move lock system to the locked position after a predetermined length of time after the lock system has been moved to the unlocked position, and the handheld mobile device comprises computer readable memory having a software application stored thereon for execution by the second processor, and including statements and instructions for execution by the second processor to perform a timer display routine that, in response to movement of the lock system to the unlocked position, shows an onscreen timer countdown of said predetermined length of time on the display screen of the handheld mobile device.

15. The electronic mailbox system of claim 14 wherein the timer display routine is arranged for early termination of the timer countdown before expiry of the predetermined length of time in response to receipt of the unlock command from the input device prior to said expiry of the predetermined length of time.

16. The electronic mailbox system of claim 1 comprising multiple ones of said handheld mobile device, each operable to control the lock system of the mailbox.

17. The electronic mailbox system of claim 16 wherein each handheld mobile device is arranged to receive said incoming mail received signal and generated a respective mail received alert in response to same.

18. The electronic mailbox system of claim 1 wherein the mailbox comprises a location determining device operable to determine a location of the mailbox and generate a locating signal containing location data on said location for transmission of said data from the mailbox, the at least one output device of the handheld mobile device comprises a display screen, and the handheld mobile device comprises computer readable memory having a software application stored thereon for execution by the processor, including a tracking function operable to receive an incoming location signal containing said location data and show a map on the display screen together with a positional marker displayed on said map at a position thereon according to the location data, whereby the user can track the location of the mailbox if stolen from an originally installed location of said mailbox.

19. A method of managing receipt of physical mail at a mailbox, the method comprising:

at the mailbox, in response to receipt of a piece of mail in an inner cavity of the mailbox through a slot of said mailbox, transmitting an external mail received signal to a remote location;

at the remote location, on a handheld mobile device comprising a smart phone or tablet computer, receiving an incoming mail received signal through a wireless telecommunications network based on said external mail received signal transmitted from the mailbox, and in response to receipt of said incoming mail signal, generating a mail received alert and conveying said mail received alert to a user of said mobile handheld device;

after departure of the user of the mobile handheld device from the remote location and arrival of said user at a site of the mailbox, receiving an unlock command at the mobile handheld device from the user through an input device of said mobile handheld device, and in response to said unlock command, sending an outgoing unlock signal from the mobile handheld device;

at the mailbox, based on the outgoing unlock signal from the mobile handheld device, sending an internal unlock signal to a locking system of the mailbox to unlock a lid of the mailbox to enable manual access to the inner cavity thereof; and after removal of the piece of mail from the inner cavity of the mailbox and re-closing of the lid of said mailbox, sending a lock signal to the locking system in order to re-lock the lid of the mailbox to securely enclose the inner cavity thereof.

20. The electronic mailbox system of claim 1 wherein the the handheld mobile device is arranged to transmit the outgoing unlock signal from the second transmitter of the handheld mobile device via the wireless telecommunications network.

* * * * *